US009354545B2

(12) United States Patent
Matsui et al.

(10) Patent No.: US 9,354,545 B2
(45) Date of Patent: May 31, 2016

(54) DEVELOPING APPARATUS, DEVELOPING METHOD, IMAGE-FORMING APPARATUS, AND IMAGE-FORMING METHOD

(71) Applicant: CANON KABUSHIKI KAISHA, Tokyo (JP)

(72) Inventors: Takashi Matsui, Mishima (JP); Michihisa Magome, Mishima (JP); Kozue Uratani, Mishima (JP); Atsuhiko Ohmori, Suntou-gun (JP); Masaki Yamada, Mishima (JP); Minoru Ito, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 14 days.

(21) Appl. No.: 14/568,058

(22) Filed: Dec. 11, 2014

(65) Prior Publication Data

US 2015/0185657 A1 Jul. 2, 2015

(30) Foreign Application Priority Data

Dec. 26, 2013 (JP) ..... 2013-269667

(51) Int. Cl.
*G03G 15/08* (2006.01)
*G03G 9/083* (2006.01)
(Continued)

(52) U.S. Cl.
CPC ..... *G03G 15/0812* (2013.01); *G03G 9/0833* (2013.01); *G03G 9/0834* (2013.01); *G03G 9/0836* (2013.01); *G03G 9/09328* (2013.01);
(Continued)

(58) Field of Classification Search
CPC ... G03G 9/0803; G03G 9/086; G03G 9/0833; G03G 9/08711; G03G 9/09725
See application file for complete search history.

(56) References Cited

U.S. PATENT DOCUMENTS 7,239,831 B2 7/2007 Hagiwara et al.
7,361,442 B2 4/2008 Otake et al.
8,883,389 B2 11/2014 Matsui et al.
(Continued)

FOREIGN PATENT DOCUMENTS

JP 57-5047 A 1/1982
JP 2005-173484 A 6/2005
(Continued)

OTHER PUBLICATIONS

U.S. Appl. No. 14/573,375, filed Dec. 17, 2014. Inventor: Ito, et al.
(Continued)

*Primary Examiner* — Peter Vajda
(74) *Attorney, Agent, or Firm* — Fitzpatrick, Cella, Harper and Scinto

(57) ABSTRACT

Provided is a developing apparatus, including: a toner for developing an electrostatic latent image; a toner carrier for carrying the toner; and a regulating member for regulating a layer thickness of the toner carried by the toner carrier, in which: the toner includes a toner containing toner particles each containing a binder resin and a magnetic material, and inorganic fine particles present on surfaces of the toner particles; the toner has a dielectric loss factor (∈") at a frequency of 100 kHz and a temperature of 30° C. of 0.03 pF/m or more and 0.30 pF/m or less; the toner carrier includes a substrate, an elastic layer, and a surface layer containing a urethane resin; and the urethane resin has a partial structure derived from a reaction between a compound represented by the structural formula (1) and a polyisocyanate.

20 Claims, 2 Drawing Sheets

(51) Int. Cl.
*G03G 9/093* (2006.01)
*G03G 9/097* (2006.01)

(52) U.S. Cl.
CPC ..... *G03G 9/09385* (2013.01); *G03G 9/09708* (2013.01); *G03G 15/0818* (2013.01)

(56) References Cited

U.S. PATENT DOCUMENTS

| | | | | |
|---|---|---|---|---|
| 8,918,035 | B2 | 12/2014 | Hasegawa et al. | |
| 2012/0196219 | A1* | 8/2012 | Moribe ..... | G03G 9/0835 430/106.1 |
| 2012/0231384 | A1 | 9/2012 | Aoki et al. | |

FOREIGN PATENT DOCUMENTS

| | | | |
|---|---|---|---|
| JP | 2006-154093 | A | 6/2006 |
| JP | 2012-14166 | A | 1/2012 |

OTHER PUBLICATIONS

U.S. Appl. No. 14/571,683, filed Dec. 16, 2014. Inventor: Wakabayashi, et al.

U.S. Appl. No. 14/568,061, filed Dec. 11, 2014. Inventor: Magome, et al.

U.S. Appl. No. 14/568,062, filed Dec. 11, 2014. Inventor: Magome, et al.

* cited by examiner

DEVELOPING APPARATUS, DEVELOPING METHOD, IMAGE-FORMING APPARATUS, AND IMAGE-FORMING METHOD

BACKGROUND OF THE INVENTION

1. Field of the Invention

The present invention relates to a developing apparatus, a developing method, an image-forming apparatus, and an image-forming method each utilizing electrophotography.

2. Description of the Related Art

Although many methods have each been known as electrophotography, a general method is as described below. An electrostatic latent image is formed on an electrostatic latent image bearing member utilizing a photoconductive material by various units. Next, the electrostatic latent image is developed with toner to form a toner image and the toner image is transferred onto a recording medium such as paper. After that, the toner image is fixed onto the recording medium by heat and/or a pressure to provide a copy. A copying machine, a printer, or the like is available as an image-forming apparatus utilizing such electrophotography.

The transition of such printer or copying machine from an analog system to a digital system has progressed in recent years, and hence the printer or the copying machine has been required to have excellent electrostatic latent image reproducibility and a high resolution. In addition, the downsizing of, in particular, the printer has been strongly required.

The printer has heretofore been used in the following manner in many cases. The printer is connected to the network and many persons perform printing with the printer. However, a demand for the following manner has been growing in recent years. A PC and the printer are placed on an individual's desk, and the individual performs printing at hand. To this end, the space savings of the printer is necessary and hence the requirement for the downsizing of the printer has been strong.

In addition, even such compact printer has been strongly desired to have high image quality and a small variation in image quality (high stability) not only under a normal-temperature and normal-humidity environment but also under a high-temperature and high-humidity environment or the like.

Here, attention is paid to the downsizing of the printer. The downsizing of a fixing apparatus and the downsizing of a developing apparatus are mainly effective for the downsizing. In particular, the latter accounts for a considerable portion of the volume of the printer and hence the downsizing of the developing apparatus can be said to be essential for the downsizing of the printer.

A development system is considered. A two-component development system or a one-component development system is available as the development system of the printer, but the one-component development system is suitable in a sense that a compact printer can be achieved. This is because the one-component development system is a development system using no carrier.

Next, the downsizing of a developing apparatus adopting the one-component development system is considered. A reduction in diameter of an electrostatic latent image bearing member or a toner carrier is effective for the downsizing of the developing apparatus. In addition, a development system in which the toner carrier and the electrostatic latent image bearing member are placed so as to be brought into contact with each other (placed so as to abut with each other) (hereinafter sometimes referred to as "contact development system") is preferred from the viewpoint of high image quality.

The following attempt has been made as additional downsizing of a developing apparatus adopting such contact development system (see Japanese Patent Application Laid-Open No. 2005-173484 and Japanese Patent Application Laid-Open No. 2006-154093). The apparatus is downsized by avoiding the use of a toner-supplying member to be placed so as to be brought into contact with the toner carrier.

However, in such developing apparatus, problems peculiar thereto are liable to become tangible.

One of the problems is a problem called reversal fogging. Fogging is a problem in which a toner is present in a non-image portion as a region where the toner is not intended to be developed and hence the non-image portion is contaminated.

Of such phenomena called fogging, the reversal fogging is specifically the following case. For example, when the charging of the toner on the toner carrier is insufficient or when the toner is reversely charged by a certain reason (e.g., when a negatively chargeable toner is positively charged), the toner shifts to the non-image region of the electrostatic latent image bearing member and is transferred onto a recording medium such as paper.

In particular, in a downsized developing apparatus, the curvature of its toner carrier increases in association with the downsizing of the toner carrier. Accordingly, the area of a regulating portion where the toner carrier and a toner-regulating member (hereinafter sometimes simply referred to as "regulating member") abut with each other reduces, and hence it becomes difficult for a toner to undergo triboelectric charging.

When a toner-supplying member is not used in addition to the downsizing of the developing apparatus, there is no opportunity for the triboelectric charging to occur between the toner-supplying member and the toner carrier, and hence it becomes additionally difficult for the toner to undergo the triboelectric charging.

Further, such reversal fogging is particularly remarkable under a high-temperature and high-humidity environment, and when a difference between a charging bias to be applied to the electrostatic latent image bearing member and a developing bias to be applied to the toner carrier is large.

This is because of, for example, the following reasons. Under the high-temperature and high-humidity environment, the toner is hardly charged, and an insufficiently charged toner is liable to be shifted to the non-image region of the electrostatic latent image bearing member by an electric field resulting from the fact that the difference between the charging bias and the developing bias is large.

A magnetic toner whose dielectric loss factor ($\in''$) and dielectric tangent ($\tan \delta$) have been specified has been proposed as an attempt to improve the chargeability of the toner under the high-temperature and high-humidity environment (see Japanese Patent Application Laid-Open No. 2012-014166).

However, its effect is still insufficient and hence the toner has been susceptible to improvement.

SUMMARY OF THE INVENTION

An object of the present invention is to provide a developing apparatus, a developing method, an image-forming apparatus, and an image-forming method each of which can provide an image suppressed in occurrence of fogging under a high-temperature and high-humidity environment.

According to one embodiment of the present invention, there is provided a developing apparatus for developing an electrostatic latent image formed on a surface of an electrostatic latent image bearing member to form a toner image on the surface of the electrostatic latent image bearing member, the developing apparatus including:

a toner for developing the electrostatic latent image;

a toner carrier for carrying the toner; and a regulating member for regulating a layer thickness of the toner carried by the toner carrier, in which:

the toner includes a toner containing toner particles each containing a binder resin and a magnetic material, and inorganic fine particles present on surfaces of the toner particles;

the toner has a dielectric loss factor (∈") at a frequency of 100 kHz and a temperature of 30° C. of 0.03 pF/m or more and 0.30 pF/m or less;

the toner carrier includes a substrate, an elastic layer, and a surface layer containing a urethane resin; and the urethane resin has a partial structure derived from a reaction between a compound represented by the following structural formula (1) and a polyisocyanate.

Structural formula (1)

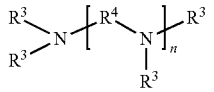

In the structural formula (1):

n represents an integer of 1 or more and 4 or less;

$R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the following structural formula (2); and $R^4$ represents an alkylene group having 2 or more and 4 or less carbon atoms:

Structural formula (2)

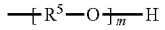

in the structural formula (2):

m is 2 or 3; and $R^5$ represents an alkylene group having 2 or more and 5 or less carbon atoms.

In addition, according to one embodiment of the present invention, there is provided a developing method, including developing an electrostatic latent image formed on a surface of an electrostatic latent image bearing member with a developing apparatus to form a toner image on the surface of the electrostatic latent image bearing member, wherein:

the developing apparatus includes a toner for developing the electrostatic latent image;

a toner carrier for carrying the toner, and a regulating member for regulating a layer thickness of the toner carried by the toner carrier;

the toner comprises a toner containing toner particles each containing a binder resin and a magnetic material, and inorganic fine particles present on surfaces of the toner particles;

the toner has a dielectric loss factor (∈") at a frequency of 100 kHz and a temperature of 30° C. of 0.03 pF/m or more and 0.30 pF/m or less;

the toner carrier includes a substrate, an elastic layer, and a surface layer containing a urethane resin; and the urethane resin has a partial structure derived from a reaction between a compound represented by the structural formula (1) and a polyisocyanate.

In addition, according to one embodiment of the present invention, there is provided an image-forming apparatus, including:

an electrostatic latent image bearing member;

an image exposure unit for forming an electrostatic latent image on a surface of the electrostatic latent image bearing member; and a developing apparatus for developing the electrostatic latent image formed on the surface of the electrostatic latent image bearing member, in which the developing apparatus includes the developing apparatus of the present invention.

In addition, according to one embodiment of the present invention, there is provided an image-forming method, including:

an image exposure step of forming an electrostatic latent image on a surface of an electrostatic latent image bearing member; and a developing step of developing the electrostatic latent image formed on the surface of the electrostatic latent image bearing member, in which the developing step is performed by the developing method of the present invention.

According to embodiments of the present invention, it is possible to provide the developing apparatus, the developing method, the image-forming apparatus, and the image-forming method each of which can provide an image suppressed in occurrence of fogging under a high-temperature and high-humidity environment.

Further features of the present invention will become apparent from the following description of exemplary embodiments with reference to the attached drawings.

DESCRIPTION OF THE EMBODIMENTS

Figure 1:
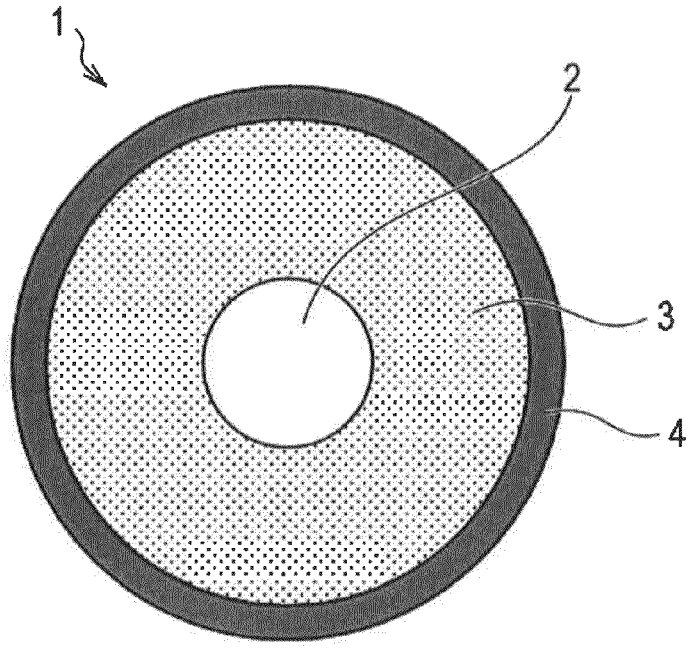
FIG. 1 is a schematic sectional view illustrating an example of a toner carrier according to the present invention.

Preferred embodiments of the present invention will now be described in detail in accordance with the accompanying drawings.

A developing apparatus of the present invention is a developing apparatus for developing an electrostatic latent image formed on a surface of an electrostatic latent image bearing member to form a toner image on the surface of the electrostatic latent image bearing member, the developing apparatus including:

a toner for developing the electrostatic latent image;

a toner carrier for carrying the toner; and a regulating member for regulating a layer thickness of the toner carried by the toner carrier, in which:

the toner includes a toner containing toner particles each containing a binder resin and a magnetic material, and inorganic fine particles present on surfaces of the toner particles;

the toner has a dielectric loss factor (∈") at a frequency of 100 kHz and a temperature of 30° C. of 0.03 pF/m or more and 0.30 pF/m or less;

the toner carrier includes a substrate, an elastic layer, and a surface layer containing a urethane resin; and the urethane resin has a partial structure derived from a reaction between a compound represented by the following structural formula (1) and a polyisocyanate.

Structural formula (1)

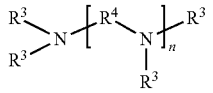

In the structural formula (1):

n represents an integer of 1 or more and 4 or less;

$R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the following structural formula (2); and $R^4$ represents an alkylene group having 2 or more and 4 or less carbon atoms:

Structural formula (2)

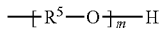

in the structural formula (2):

m is 2 or 3; and $R^5$ represents an alkylene group having 2 or more and 5 or less carbon atoms.

The inventors of the present invention have made detailed studies, and as a result, have found that the combined use of a toner carrier whose surface layer contains a specific urethane resin and a toner whose dielectric loss factor (∈") has been specified can reduce fogging under a high-temperature and high-humidity environment.

A reason for the foregoing is described below.

First, with regard to the fogging under the high-temperature and high-humidity environment, the following two conditions may be necessary for obtaining uniform chargeability under the high-temperature and high-humidity environment where a toner is hardly charged.

A first condition is that the chargeability of a member is high.

A second condition is that a charged toner does not lose its charge.

With regard to the first condition, i.e., the chargeability of the member, the toner can be charged by being brought into contact with the toner carrier and being rubbed with the carrier. In view of the foregoing, the inventors of the present invention have made various studies on a compound to be incorporated into the surface layer of the toner carrier, and as a result, have found that a urethane resin having a partial structure derived from a reaction between a compound represented by the structural formula (1) and a polyisocyanate has a high charging ability.

The reason for the foregoing is as described below. The compound represented by the structural formula (1) has a nitrogen atom (N) at its center and the nitrogen atom has a lone pair, and hence the compound represented by the structural formula (1) is a Lewis base. The Lewis base is electron donative, and hence the toner can be rapidly charged by being brought into contact with the urethane resin having the partial structure derived from the reaction between the compound represented by the structural formula (1) and the polyisocyanate. In addition, the reaction between the compound represented by the structural formula (1) and the isocyanate results in the formation of such a crosslinked structure that many urethane groups or urea groups are produced around the structure of the compound represented by the structural formula (1). As a result, the microscopic hardness of the compound increases, and hence the toner seldom caves in the surface of the toner carrier even upon regulation of the toner in a portion where a toner-regulating member and the toner carrier abut with each other (hereinafter sometimes referred to as "regulating portion"). As a result, good rolling property of the toner can be maintained and hence chargeability to the toner improves.

In addition, in general, all functional groups of a compound having a low molecular weight and multifunctionality tend to hardly react owing to steric hindrance.

However, the compound represented by the structural formula (1) is reduced in production of an unreacted component because the reactivity of a hydroxyl group or amino group at a terminal is improved by an amino skeleton in a molecule thereof. Accordingly, uniformity in charging improves and the uniformity of the crosslinked structure can be improved.

Next, the second condition, i.e., the charge loss of the charged toner is described.

The toner is conveyed by the toner carrier and the toner is replaced in a regulating portion by a pressing force. At this time, the toner is brought into contact with the toner carrier and rubbed. Thus, the toner is charged and provided with charge. The toner provided with the charge shifts to a portion corresponding to the electrostatic latent image of the electrostatic latent image bearing member in a developing portion where the toner carrier and the electrostatic latent image bearing member abut with each other, and is developed.

Meanwhile, the toner provided with the charge is not shifted to any portion except the electrostatic latent image of the electrostatic latent image bearing member in the developing portion, and remains on the toner carrier.

However, in the process of their extensive studies, the inventors of the present invention have revealed that in a contact developing apparatus in which its toner carrier and electrostatic latent image bearing member are placed so as to be brought into contact with each other, when a toner provided with charge passes its developing portion, the charge of the toner may be lost. The inventors have further continued studies, and in the process of the studies, have revealed that such charge loss in the developing portion is remarkable under a high-temperature and high-humidity environment, and when a difference between a charging bias and a developing bias is large.

The foregoing may be caused by the following facts: under the high-temperature and high-humidity environment, the toner is hardly charged owing to an influence of humidity and the charge of the toner is liable to leak. The foregoing may also be caused by the fact that when the difference between the charging bias and the developing bias is large, an electric field is generated in the developing portion and hence the charge that has leaked out of the toner is liable to flow to a member or the like.

To suppress the charge loss, the inventors have made various studies, and in the process of the studies, have found that the charge loss correlates with the dielectric loss factor of the toner at a frequency of 100 kHz and a temperature of 30° C. In other words, the toner is more liable to lose its charge as a value for the dielectric loss factor (∈") increases.

By such reason, in the present invention, the dielectric loss factor (∈") of the toner is preferably 0.03 pF/m or more and 0.30 pF/m or less, more preferably 0.05 pF/m or more and 0.25 pF/m or less.

The dielectric loss factor (∈") is an indicator of the ease of the abandonment (dielectric loss) of the charge. That is, when the dielectric loss factor (∈") is 0.30 pF/m or less, the toner hardly loses the charge in the developing portion and hence reversal fogging can be suppressed. Further, when the dielectric loss factor (∈") is 0.25 pF/m or less, the toner is less liable to lose the charge.

Meanwhile, when the dielectric loss factor (∈") is 0.03 pF/m or more, excessive charging of the toner hardly occurs in the regulating portion and hence a reduction in density due to its charge-up can be suppressed. Further, when the dielectric loss factor (∈") is 0.05 pF/m or more, the reduction in density due to the charge-up can be additionally suppressed.

The inventors have made further studies on the reversal fogging, and in the process of the studies, have found that the reversal fogging can be drastically suppressed by using the toner carrier whose surface layer contains a specific urethane resin, and toner whose dielectric loss factor (∈") has been specified, of the present invention. The inventors have considered that the foregoing is because of the following two reasons.

A first reason is that in addition to the fact that the chargeability of the toner carrier is high as described in the foregoing, the dielectric loss factor of the toner is low and hence the toner can be efficiently charged in the regulating portion as compared with a conventional developing apparatus.

A second reason is that in addition to the fact that the toner hardly loses the charge in the developing portion because the dielectric loss factor of the toner is low as described in the foregoing, the combination of the toner with the toner carrier of the present invention suppresses the flow of the charge that has leaked out of the toner to the toner carrier. First, the inventors have considered that the foregoing is because the toner hardly loses the charge and hence the quantity of the charge to leak is reduced. In addition, the compound represented by the structural formula (1) to be used in the surface layer of the toner carrier is a Lewis base and electron donative. Accordingly, the inventors have considered that the foregoing is because even when the charge leaks out of the toner, the leak of the charge to the toner carrier can be suppressed. Further, the reaction between the compound represented by the structural formula (1) and the isocyanate results in the formation of such a crosslinked structure that many urethane groups or urea groups are produced around the structure of the compound represented by the structural formula (1). As a result, the microscopic hardness of the compound increases and hence the contact area of the developing portion can be reduced. Accordingly, the area where the toner receives the electric field in the developing portion reduces and hence the charge loss of the toner is easily suppressed.

The inventors of the present invention have considered that the reversal fogging is drastically suppressed not only because the chargeability of the toner carrier is high but also because the dielectric loss factor of the toner is low as described above.

It should be noted that in order that the value for the dielectric loss factor (∈") of the toner may be controlled, it is important to control a structure near the surface of each toner particle.

For example, the dielectric loss factor (∈") of a magnetic material tends to be higher than that of, for example, a polyester to be used as a binder resin or in the shell of a core-shell structure. When such magnetic material whose dielectric loss factor is liable to be high is present near the surface of the toner particle, the charge of the toner is liable to be lost.

That is, the magnetic material is preferably absent near the surface of the toner particle. In addition, the presence of a variation in amount of presence of the magnetic material between toner particles also tends to increase the dielectric loss factor (∈"). Although the reason for the foregoing has not been elucidated, a variation in charge quantity between the toner particles is liable to occur owing to the presence of the variation in amount of presence of the magnetic material. When the variation in charge quantity between the toner particles occurs, charge is liable to transfer from a toner particle having a high charge quantity to a toner particle having a low charge quantity. The inventors have assumed that the charge is liable to be lost upon such charge transfer.

In addition, in, for example, the case where the polyester is used in the shell of the core-shell structure, when the polyester uniformly covers the surface of each toner particle, the dielectric loss factor (∈") is easily reduced.

The inventors have assumed that this is because of the following reason. In addition to the above-mentioned fact that the exposure and the like of the magnetic material are easily suppressed, surface composition becomes uniform, and hence the variation in charge quantity between the toner particles can be reduced and the charge exchange between the toner particles described in the foregoing hardly occurs. Accordingly, the dielectric loss factor (∈") is easily reduced.

Further, under a high-temperature and high-humidity environment, the charge of the toner may be lost by moisture. Accordingly, the hydrophobicity of the magnetic material, the acid value of the polyester, and the like are also preferably controlled because the dielectric loss factor (∈") is easily reduced.

Next, the dielectric constant (∈') of the toner to be used in the present invention is preferably 25 or more and 35 or less. The dielectric constant (∈') is an indicator of the ease with which the toner holds the charge. When the dielectric constant (∈') of the toner is 25 or more, the toner can sufficiently hold the toner upon its triboelectric charging in the regulating portion and hence fogging due to insufficient charging can be suppressed. Meanwhile, when the dielectric constant (∈') is 35 or less, the reduction in density due to the charge-up can be suppressed. In addition, the charge quantity of the toner rapidly reaches its saturation value with ease, and hence the charge quantities of the toner particles easily become uniform and the reversal fogging is easily suppressed.

In order that a value for such dielectric constant (∈') may be controlled, it is preferred to control the amount of the magnetic material, and the hydrophobicity and state of presence of the magnetic material described in the foregoing, and, for example, when the polyester is used as a binder resin or in the shell of the core-shell structure, the kind and state of presence of the polyester.

The moisture adsorption amount of the toner to be used in the present invention at a temperature of 30° C. and a humidity of 90% is preferably 2.5 mg/g or less.

When the moisture adsorption amount at a temperature of 30° C. and a humidity of 90% is 2.5 mg/g or less, the toner hardly absorbs moisture, and hence the toner easily undergoes triboelectric charging in the regulating portion and the fogging is alleviated. In addition, the charge loss in the developing portion is easily suppressed and hence the reversal fogging is alleviated. Available as a method of controlling the moisture adsorption amount of the toner is, for example, an improvement in hydrophobicity of the magnetic material, the adjustment of the amount of the magnetic material, or the adjustment of the dispersed state of the magnetic material. For example, when the polyester is used in the shell of the core-shell structure, the moisture adsorption amount can be controlled by, for example, reducing the acid value of the polyester, adjusting the amount of the polyester, improving the hydrophobicity of inorganic fine particles, or adjusting the amount of the inorganic fine particles.

The weight average particle diameter (D4) of the toner to be used in the present invention is preferably 5.0 μm or more and 12.0 μm or less, more preferably 5.5 μm or more and 11.0 μm or less. When the weight average particle diameter (D4) falls within the range, the toner obtains good flowability and easily undergoes triboelectric charging in the regulating portion, and hence the fogging is easily alleviated and a latent image can be faithfully developed.

The average circularity of the toner to be used in the present invention is preferably 0.950 or more. When the average circularity of the toner is 0.950 or more, the shape of the toner becomes a spherical shape or a shape close thereto. Accordingly, the toner is excellent in flowability and easily obtains uniform triboelectric chargeability, and hence the fogging under a high-temperature and high-humidity environment is additionally alleviated. In addition, a mode circularity in the circularity distribution of the toner is extremely preferably 0.98 or more because the action becomes additionally significant.

The glass transition temperature (Tg) of the toner to be used in the present invention is preferably 40.0° C. or more and 70.0° C. or less. When the glass transition temperature is 40.0° C. or more and 70.0° C. or less, the storage stability and durability of the toner can be improved while its good fixability is maintained.

Examples of the binder resin of the toner particles to be used in the present invention include a vinyl-based resin and a polyester-based resin.

Specific examples of the binder resin that can be used include: homopolymers of styrene and substituted derivatives thereof, such as polystyrene and polyvinyl toluene; styrene-based copolymers such as a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleic acid ester copolymer; and polymethyl methacrylate, polybutyl methacrylate, polyvinyl acetate, polyethylene, polypropylene, polyvinylbutyral, a polyester resin, a polyamide resin, an epoxy resin, and a polyacrylic acid resin. One kind of those resins may be used alone, or two or more kinds thereof may be used in combination. Of those, a styrene-based copolymer is particularly preferred in terms of, for example, developing characteristic and fixability. Further, a styrene-butyl acrylate copolymer is more preferred because the copolymer easily increases the dielectric constant (∈'), easily reduces the dielectric loss factor (∈"), easily reduces the moisture absorptivity, and can alleviate the fogging under a high-temperature and high-humidity environment.

The toner particles to be used in the present invention may each contain a charge control agent as required in order to improve charging characteristics. Various agents can be utilized as the charge control agent, and a charge control agent having the following characteristics is particularly preferred: the agent can be charged at a high speed, and can stably maintain a certain charge quantity. Further, when the toner is produced by a polymerization method as described later, a charge control agent having the following characteristics is particularly preferred: the agent has low polymerization-inhibiting property, and is substantially free of any soluble matter in an aqueous dispersion medium. Specific examples of the charge control agent include: metal compounds of aromatic carboxylic acids such as salicylic acid, an alkylsalicylic acid, a dialkylsalicylic acid, naphthoic acid, and dicarboxylic acids; metal salts and metal complexes of azo dyes and azo pigments; polymer compounds each having a sulfonic acid group or carboxylic acid group in a side chain; boron compounds; urea compounds; silicon compounds; and calixarenes.

When such charge control agent is internally added to each toner particle, the charge control agent is used in an amount in the range of preferably from 0.1 part by mass or more to 10.0 parts by mass or less, more preferably from 0.1 part by mass or more to 5.0 parts by mass or less with respect to 100 parts by mass of the binder resin. In addition, when the charge control agent is externally added to each toner particle, the usage is preferably 0.005 part by mass or more and 1.000 part by mass or less, more preferably 0.010 part by mass or more and 0.300 part by mass or less with respect to 100 parts by mass of the toner.

The toner particles to be used in the present invention may each contain a release agent for an improvement in fixability. The content of the release agent in the toner particles is preferably 1.0 mass % or more and 30.0 mass % or less, more preferably 3.0 mass % or more and 25.0 mass % or less with respect to the binder resin.

When the content of the release agent is 1.0 mass % or more, a low temperature offset-suppressing effect becomes higher. In addition, when the content of the release agent is 30.0 mass % or less, the long-term storage stability of the toner improves, and the charging uniformity of the toner improves by virtue of the suppression of the exudation of the release agent to the surface of the toner particle and hence the fogging is easily alleviated.

Examples of the release agent include: petroleum-based wax such as paraffin wax, microcrystalline wax, or petrolactum and derivatives thereof; montan wax and derivatives thereof; hydrocarbon wax obtained by the Fischer Tropsch process and derivatives thereof; polyolefin wax such as polyethylene and derivatives thereof; and natural wax such as carnauba wax or candelilla wax and derivatives thereof. The derivatives include an oxide, and a block copolymer or graft-modified product with a vinyl-based monomer. In addition, there may also be used as the release agent, for example, a higher aliphatic alcohol, a fatty acid such as stearic acid or palmitic acid, acid amide wax, ester wax, hydrogenated castor oil and a derivative thereof, vegetable wax, and animal wax.

In addition, the melting point of any such release agent specified by the highest endothermic peak temperature at the time of temperature increase measured with a differential scanning calorimeter (DSC) is preferably 60° C. or more and 140° C. or less, more preferably 65° C. or more and 120° C. or less. When the melting point is 60° C. or more, the viscosity of the toner easily increases and hence its fusion to the toner carrier hardly occurs. When the melting point is 140° C. or less, the low-temperature fixability of the toner hardly reduces.

The melting point of the release agent is defined as the peak top of its endothermic peak upon measurement with the DSC. In addition, the measurement of the peak top of the endothermic peak is performed in conformity with ASTM D 3417-99. For example, a DSC-7 manufactured by PerkinElmer, Inc., a DSC2920 manufactured by TA Instruments, or a Q1000 manufactured by TA Instruments can be used in such measurement. The melting points of indium and zinc are used for the temperature correction of the detecting portion of any such apparatus, and the heat of fusion of indium is used for the correction of a heat quantity. In the measurement, a pan made of aluminum is used for a measurement sample and an empty pan is set for reference.

The toner particles to be used in the present invention each contain a magnetic material. The content of the magnetic material in the toner particles is preferably 50 parts by mass or more and 90 parts by mass or less, more preferably 60 parts by mass or more and 80 parts by mass or less with respect to 100 parts by mass of the binder resin. When the content is 50 parts by mass or more, the coloring power of the toner improves and hence an image density is easily increased. When the content is 60 parts by mass or more, the image density is more easily increased. Meanwhile, when the content is 90 parts by mass or less, the dielectric constant ($\in'$) is easily increased and the dielectric loss factor ($\in''$) is easily reduced. Accordingly, the chargeability of the toner in the regulating portion easily improves and the charge loss in the developing portion is easily suppressed, and hence the fogging is easily alleviated. When the content is 80 parts by mass or less, the charge loss is more easily suppressed.

The content of the magnetic material in the toner particles can be measured with a thermal analyzer TGA7 manufactured by PerkinElmer, Inc. A method for the measurement is as described below.

Under a nitrogen atmosphere, the toner is heated from normal temperature to 900° C. at a rate of temperature increase of 25° C./min. The loss (mass %) in the range of from 100° C. to 750° C. is defined as the amount of the binder resin, and the remaining mass is approximately defined as the amount of the magnetic material.

The magnetic material preferably uses a magnetic iron oxide such as triiron tetraoxide or γ-iron oxide as a main component, and may contain an element such as phosphorus, cobalt, nickel, copper, magnesium, manganese, aluminum, or silicon.

The magnetic material has a BET specific surface area determined by a nitrogen adsorption method of preferably 2.0 $m^2/g$ or more and 20.0 $m^2/g$ or less, more preferably 3.0 $m^2/g$ or more and 10.0 $m^2/g$ or less.

The shape of the magnetic material is, for example, a polyhedral shape, an octahedral shape, a hexahedral shape, a spherical shape, a needle shape, or a scaly shape. The magnetic material preferably has a shape with a low degree of anisotropy, such as a polyhedral shape, an octahedral shape, a hexahedral shape, or a spherical shape in order to increase an image density. The volume average particle diameter (Dv) of the magnetic material is preferably 0.10 μm or more and 0.40 μm or less from the viewpoints of its uniform dispersibility in the toner and tinge.

The volume average particle diameter (Dv) of the magnetic material can be measured with a transmission electron microscope. Specifically, the toner particles to be observed are sufficiently dispersed in an epoxy resin, and then the resultant is cured in an atmosphere having a temperature of 40° C. for 2 days so that a cured product may be obtained. The resultant cured product is turned into a flaky sample with a microtome, and then the sample is photographed with a transmission electron microscope (TEM) at a magnification of from 10,000 to 40,000. The diameters of 100 treated magnetic material particles in the field of view of the photograph are measured. Then, the volume average particle diameter (Dv) is calculated based on the equivalent diameter of a circle equal in area to the projected area of the treated magnetic material. Alternatively, the particle diameters can be measured with an image analyzer.

The state of presence of the magnetic material in each toner particle is preferably as follows in order that the dielectric loss factor ($\in''$) may be reduced: the magnetic material is not exposed to the surface of the toner particle and is present inside of the particle, not on the surface. In addition, the amounts of presence and states of presence of the magnetic material of the toner particles are preferably uniform in order that the dielectric loss factor ($\in''$) may be reduced. A toner having such dispersed state of the magnetic material is, for example, such a toner that the magnetic material is subjected to desired hydrophobic treatment and its toner particles are produced by suspension polymerization.

Described below is the form of the magnetic material that can be preferably used in the suspension polymerization as a preferred method of producing the toner particles of the present invention.

The suspension polymerization method as a preferred toner production method of the present invention involves: forming particles of a polymerizable monomer composition containing a polymerizable monomer and a magnetic material in an aqueous medium; and polymerizing the polymerizable monomer in each particle. Accordingly, the surface of the magnetic material to be used is preferably subjected to hydrophobic treatment so that the magnetic material may not be exposed to an aqueous system. When the magnetic material to be used is exposed to the aqueous system, the granulation property of a magnetic toner reduces, and hence its particle size distribution may be disturbed or the magnetic material may not be incorporated into the toner particles.

This is because a functional group such as a hydroxyl group is typically present on the surface of an untreated magnetic material and hence its hydrophilicity is high.

Here, a silane compound, a titanate compound, an aluminate compound, and the like have been generally known as surface treatment agents. Each of those surface treatment agents hydrolyzes and undergoes a condensation reaction with a hydroxyl group on the surface of the magnetic material to form a strong chemical bond, thereby exhibiting hydrophobicity.

However, it has been known that once any such compound hydrolyzes, the compound is liable to cause self-condensation to produce a polymer or an oligomer. On the other hand, when a condition for the hydrolysis of the silane compound is controlled, its self-condensation can be suppressed while its hydrolysis ratio is increased. Accordingly, the compound can uniformly treat the surface of the magnetic material and is hence preferably used. The inventors of the present invention have considered that this is because the activity of silicon of the silane compound is not as high as that of titanium or aluminum. It is preferred that the surface of the magnetic material be uniformly treated with the silane compound as described above because the magnetic material is not exposed to the surfaces of the toner particles, the amounts of presence, and states of presence, of the magnetic material of the toner particles become uniform, and the dielectric loss factor (∈") is easily reduced.

In addition, a preferred silane compound contains, for example, a compound having a hydrocarbon group having 4 or more and 10 or less carbon atoms as a main component.

The inventors of the present invention have considered that this is because the length of the hydrocarbon group in the silane compound is related to one factor that determines the hydrophobicity of the magnetic material involved in the inclusion of the magnetic material.

There is a high correlation between the length of the hydrocarbon group and the number of its carbon atoms, and when the number of the carbon atoms is 4 or more, the property by which the magnetic material is included in the toner improves, and hence the dielectric loss factor (∈") is easily reduced and the fogging is easily alleviated. When the number of the carbon atoms is 10 or less, the surface treatment of iron oxide easily becomes uniform and hence the dispersibility of the magnetic material in the toner improves. Accordingly, the toner is uniformly charged with ease and the fogging is easily alleviated.

In addition, it is preferred that: the silane compound for treating the magnetic material to be used in the method of producing the magnetic toner be a compound obtained by subjecting an alkoxysilane to hydrolysis treatment; and the hydrolysis ratio of the alkoxysilane be 50% or more.

In general, the silane compound is used without being hydrolyzed and used as it is in the treatment in many cases. In such cases, however, the compound cannot form a chemical bond with, for example, a hydroxyl group on the surface of the magnetic material and hence has only a strength not more than physical adhesion. In this state, the silane compound is liable to desorb owing to, for example, a shear which the compound receives upon toner production or the polymerizable monomer.

In addition, when the surface treatment is performed, in general, the silane compound is added and mixed before heat is applied.

However, as a result of their detailed studies, the inventors of the present invention have found the following. The application of heat having a temperature of from about 100° C. to 120° C. volatilizes the silane compound that has not hydrolyzed from the surface of the magnetic material. Accordingly, a hydroxyl group or a silanol group remains on the surface of the magnetic material after the volatilization of the silane compound, which makes it difficult to obtain high hydrophobicity.

By such reasons, in the present invention, the silane compound is preferably the compound obtained by subjecting the alkoxysilane to the hydrolysis treatment. When the alkoxysilane is subjected to the hydrolysis treatment, the silane compound adsorbs to, for example, a hydroxyl group on the surface of the magnetic material through a hydrogen bond, and the heating and dehydration of the resultant result in the formation of a strong chemical bond. In addition, the formation of the hydrogen bond can suppress the volatilization of the silane compound at the time of the heating, and hence easily improves the hydrophobicity and easily alleviates the fogging. By such reasons, in the present invention, the hydrolysis ratio of the silane compound is preferably 50% or more, more preferably 90% or more.

When the hydrolysis ratio of the silane compound is 50% or more, the surface of the magnetic material can be treated with a large amount of the treatment agent because of the foregoing reason. Further, the uniformity of the surface treatment improves and hence the dispersibility of the magnetic material becomes additionally good. Accordingly, the dielectric loss factor (∈") is easily reduced and the fogging is easily alleviated.

It should be noted that the hydrolysis ratio of the silane compound is a value obtained by subtracting the ratio of a remaining alkoxy group from a hydrolysis ratio of 100% corresponding to a state where the alkoxysilane is completely hydrolyzed.

The hydrolysis of the alkoxysilane is preferably performed as described below. Specifically, the alkoxysilane is gradually loaded into an aqueous solution whose pH value has been adjusted to 4.0 or more and 6.5 or less, or a mixed solution of an alcohol and water, and is uniformly dispersed with, for example, a disper blade. At this time, the liquid temperature of the dispersion liquid is preferably 35° C. or more and 50° C. or less. In general, the alkoxysilane is more easily hydrolyzed as the pH value reduces and the liquid temperature increases.

At the same time, however, self-condensation is liable to occur. When the silane compound in such state is used, a magnetic material uniformly subjected to hydrophobic treatment preferred for the present invention is hardly obtained.

As described above, it has been extremely difficult to suppress the self-condensation while performing the hydrolysis of the alkoxysilane. The inventors of the present invention have made extensive studies, and as a result, have found that even under a condition under which the alkoxysilane is hardly hydrolyzed (i.e., a condition under which the self-condensation hardly occurs), the use of a dispersing apparatus capable of applying a high shear like the disper blade increases the area of contact between the alkoxysilane and water, and hence can efficiently accelerate the hydrolysis. Thus, the following has been enabled: the self-condensation is suppressed while the hydrolysis ratio is increased.

Two kinds of methods, i.e., a dry method and a wet method are each available as a method of treating the surface of the magnetic material. When the surface treatment is performed by the dry method, the silane compound is loaded into a dried magnetic material and the mixture is subjected to the surface treatment in a gas phase. When the surface treatment is performed by the wet method, the dried magnetic material is redispersed in an aqueous medium, or after the completion of an oxidation reaction, iron oxide is redispersed in another aqueous medium without being dried, followed by the performance of the surface treatment with the silane compound.

The magnetic material to be used in the present invention is preferably a magnetic material subjected to surface treatment with the silane compound in a gas phase (hereinafter sometimes referred to as "dry method").

When the magnetic material is subjected to the surface treatment in the gas phase (hereinafter sometimes referred to as "dry method"), the amount of remaining carbon derived from the silane compound to be described later can be easily increased and hence sufficient hydrophobicity is easily obtained. Accordingly, such surface treatment is preferred because the dispersibility of the magnetic material improves, the dielectric loss factor (∈") is easily reduced, and the fogging is easily alleviated.

Various stirring apparatus can each be used as an apparatus for treating the surface of the magnetic material. Specifically, for example, a Henschel mixer (Mitsui Miike Kakoki), a High-Speed Mixer (Fukae Powtec Corporation), or a Hybridizer (NARA MACHINERY CO., LTD.) is preferred.

A silicon atom is preferably present on the surface of the magnetic material to be used in the method of producing the magnetic toner to be produced by the present invention. The inventors have considered that the presence of the silicon atom improves an affinity between the surface of the magnetic material and the silane compound, and hence additionally improves the uniformity of the treatment with the silane compound. In addition, the improvement in the affinity between the surface of the magnetic material and the silane compound increases the amount of the silane compound to be bonded to the surface of the magnetic material.

By the foregoing reason, in the present invention, a specific amount of silicon atoms is preferably caused to exist on and near the surface of the magnetic material. Specifically, the magnetic material is dispersed in an aqueous solution of hydrochloric acid and the magnetic material is dissolved until the dissolution ratio of iron atoms becomes 5 mass % with respect to the amount of all iron atoms in the magnetic material. Then, the amount of silicon eluted by the time is preferably 0.05 mass % or more and 0.50 mass % or less with respect to the magnetic material.

Here, the dissolution ratio of the iron atoms of the magnetic material is described. A dissolution ratio of the iron atoms of 100 mass % refers to a state where the magnetic material is completely dissolved, and a numerical value closer to 100 mass % means that the entirety of the magnetic material is dissolved. The inventors of the present invention have made extensive studies, and as a result, have found that the magnetic material uniformly dissolves with its surface as a starting point under an acidic condition.

Accordingly, the amount of an element to be eluted by the time when the dissolution ratio of the iron atoms becomes 5 mass % is considered to represent the amount of the element present on and near the surface of the magnetic material. When the amount of silicon present on and near the surface of the magnetic material is 0.05 mass % or more, the affinity between the silane compound and the magnetic material improves as described above. In this case, the uniformity of the treatment and the like improve, the dispersibility of the magnetic material in the toner can be improved, the dielectric loss factor (∈") is easily reduced, and the fogging is easily alleviated.

Meanwhile, when the amount of silicon present on and near the surface of the magnetic material is 0.50 mass % or less, the moisture adsorption amount of the magnetic material is easily reduced and hence the moisture adsorption amount of the toner is easily reduced. Accordingly, the fogging under a high-temperature and high-humidity environment is easily alleviated.

The inventors have considered the reason for the foregoing to be as described below.

An area (coverage area) which one molecule of the silane compound for treating the surface of the magnetic material can cover is fixed. Accordingly, an upper limit for the maximum amount of the silane compound that can be condensed per unit area is determined by the coverage area. By such reason, when the silicon content is more than 0.50 mass %, silicon and a silanol group derived therefrom excessively remain on the surface of the magnetic material. As a result, the surface is liable to adsorb moisture and hence the degree of hydrophobicity of the magnetic material is liable to reduce.

In addition, such surface state of the magnetic material needs to be controlled while a preferred toner production process of the present invention is assumed.

In other words, even in a polymerizable monomer such as styrene, the amount of the silane compound on the surface needs to be maintained. As a result of their extensive studies, the inventors of the present invention have found that the amount of remaining carbon derived from the silane compound after washing with styrene is preferably 0.40 mass % or more and 1.20 mass % or less with reference to the magnetic material. The washing with styrene enables the estimation of the amount of the silane compound adhering to the surface of the magnetic material at the time of the production of the magnetic toner in the suspension polymerization method as the preferred magnetic toner production method of the present invention by the amount of remaining carbon.

The inventors of the present invention have considered that this is because a hydrocarbon group is generally important for the exhibition of the silane compound's hydrophobicity, i.e., the amount of carbon is effective in estimating its hydrophobic ability.

When the adhesion amount is 0.40 mass % or more, a sufficient hydrophobic ability is easily obtained and hence the degree of hydrophobicity increases. Accordingly, the dispersibility of the magnetic material in the toner can be improved, the dielectric loss factor (∈") is easily reduced, and the fogging is easily alleviated.

In addition, when the adhesion amount is 1.2 mass % or less, unevenness hardly occurs in the covering property of the treatment agent and hence the uniformity of the treatment easily improves. Accordingly, the dispersibility of the magnetic material in each toner particle improves and unevenness in state of presence of the magnetic material hardly occurs between the toner particles. As a result, the toner is uniformly charged with ease.

The treated magnetic material to be used in the preferred magnetic toner production method of the present invention can be produced by, for example, the following method.

An alkali such as sodium hydroxide is added to an aqueous solution of a ferrous salt in an equivalent or more with respect to the iron component so that an aqueous solution containing ferrous hydroxide may be prepared. While the pH value of the prepared aqueous solution is maintained at 7.0 or more, air is blown into the aqueous solution. Then, the oxidation reaction of ferrous hydroxide is performed while the aqueous solution is heated to 70° C. or more. Thus, seed crystals serving as the cores of magnetic iron oxide particles are produced first.

Next, an aqueous solution containing one equivalent of ferrous sulfate with reference to the addition amount of the alkali previously added is added to the slurry-like liquid containing the seed crystals. While the pH value of the resultant liquid is maintained at 5.0 or more and 10.0 or less, air is blown into the liquid. During the blowing, the reaction of ferrous hydroxide is advanced so that the magnetic iron oxide particles may be grown with the seed crystals as cores. At this time, the shape and magnetic characteristics of the magnetic material can be controlled by selecting an arbitrary pH value, an arbitrary reaction temperature, and an arbitrary agitation condition. As the oxidation reaction progresses, the pH value of the liquid shifts to acidic values. However, the pH value of the liquid is preferably prevented from becoming less than 5.0. After the completion of the oxidation reaction, a silicon source such as sodium silicate is added to adjust the pH value of the liquid to 5.0 or more and 8.0 or less. Thus, a covering layer of silicon is formed on the surface of each magnetic material particle. The magnetic material particles obtained as described above are filtered, washed, and dried by ordinary methods. Thus, the magnetic material can be obtained.

The amount of silicon atoms present on the surface of the magnetic material can be controlled by adjusting the addition amount of sodium silicate or the like to be added after the completion of the oxidation reaction.

Next, it is sufficient to subject the resultant magnetic material to the hydrophobic treatment. A silane compound that can be used in the surface treatment of the magnetic material is preferably a compound represented by the following general formula (1).

$$R_mSiY_n \quad (1)$$

(In the general formula (1), R represents an alkoxy group or a hydroxyl group, m represents an integer of 1 or more and 3 or less, Y represents an alkyl group or a vinyl group (the alkyl group may have as a substituent a functional group such as an amino group, a hydroxyl group, an epoxy group, an acryl group, or a methacryl group), n represents an integer of 1 or more and 3 or less, and m and n satisfy the relationship of m+n=4.)

Examples of the silane compound represented by the general formula (1) include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, and n-octadecyltrimethoxysilane as well as hydrolysates thereof.

When the silane compound is used, the treatment may be performed by using one kind of such compounds alone, or the treatment may be performed by using two or more kinds thereof in combination. When two or more kinds thereof are used in combination, the magnetic material may be treated with each of the silane compounds individually or may be treated with the compounds at the same time. Of those compounds, isobutyltrimethoxysilane, n-hexyltrimethoxysilane, n-octyltrimethoxysilane, n-octyltriethoxysilane, and n-decyltrimethoxysilane, each of which can uniformly coat the surface to easily improve the hydrophobicity, are preferably used.

In the present invention, any other colorant may be used in combination with the magnetic material. Various pigments and dyes, carbon black, a magnetic material, and the like can each be used as the colorant to be used in combination with the magnetic material.

When the toner particles to be used in the present invention are produced by a pulverization method, toner components such as a binder resin, a colorant, and a release agent, and any other additive are sufficiently mixed with a mixer such as a Henschel mixer or a ball mill. After that, the materials are melted and kneaded with a heat kneader such as a heating roll, a kneader, or an extruder to be dispersed or dissolved. The resultant is cooled to be solidified and the solidified product is pulverized. After that, the pulverized product is classified and is subjected to surface treatment as required. Thus, the toner particles can be obtained. The classification may be performed prior to the surface treatment and vice versa. In the classifying step, a multi-division classifier is preferably used from the viewpoint of production efficiency.

The pulverizing step can be performed by a method involving using any of various pulverizing apparatus such as mechanical impact type and jet type pulverizing apparatus. In addition, in order that the toner (toner particles) having a preferred circularity to be used in the present invention may be obtained, it is preferred that the pulverization be performed while further applying heat or treatment involving applying a mechanical impact in an auxiliary fashion be performed. Alternatively, a hot water bath method involving dispersing finely pulverized toner particles (classified as required) in hot water, a method involving passing the particles through a heat air current, or the like may be employed.

For example, a method involving using a mechanical impact type pulverizer such as a Kryptron system manufactured by Kawasaki Heavy Industries or a Turbo mill manufactured by Turbo Kogyo Co., Ltd. is given as a method of applying a mechanical impact force. Also given is a method involving pressing the toner against the inside of a casing with a blade rotating at a high speed by means of a centrifugal force and applying a mechanical impact force to the toner like a method adopted in an apparatus such as a Mechanofusion System manufactured by Hosokawa Micron Corporation.

The toner particles to be used in the present invention can be produced by the pulverization method as described above. However, the toner particles obtained by the pulverization method are generally amorphous and their flowability in the regulating portion tends to reduce. In addition, it is difficult to control the surface composition of the toner particles. Accordingly, for example, when the magnetic material is used, the magnetic material is liable to be exposed to their surfaces, which makes it difficult to control the dielectric loss factor (∈"). In view of the foregoing, in the present invention, the toner particles are preferably produced in an aqueous medium like a dispersion polymerization method, an association agglomeration method, a dissolution suspension method, a suspension polymerization method, or the like. Of those, a suspension polymerization method is more preferred.

The suspension polymerization method is a method of obtaining the toner involving: dissolving or dispersing a polymerizable monomer and a colorant (and, as required, a polymerization initiator, a crosslinking agent, a charge control agent, and any other additive) to provide a polymerizable monomer composition; then adding the polymerizable monomer composition to a continuous phase (such as an aqueous medium (a dispersion stabilizer may be incorporated as required)); then forming particles of the polymerizable monomer composition in the continuous phase (in the aqueous medium); and polymerizing the polymerizable monomer in each of the particles. The shapes of the respective toner particles of the toner obtained by the suspension polymerization method (hereinafter sometimes referred to as "polymerized toner") are substantially uniformized to a spherical shape. Accordingly, their flowability in the regulating portion easily improves and the toner particles easily undergo triboelectric charging, and hence the fogging can be alleviated. Further, an improvement in image quality can be expected of such toner because its charge quantity distribution also becomes relatively uniform.

Examples of the polymerizable monomer to be used in the production of the polymerized toner include the following.

Examples of the polymerizable monomer include: styrene-based monomers such as styrene, o-methylstyrene, m-methylstyrene, p-methylstyrene, p-methoxystyrene, and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and other monomers such as acrylonitrile, methacrylonitrile, and acrylamide. One kind of those monomers may be used alone, or two or more kinds thereof may be used in combination.

Of the polymerizable monomers, styrene or a styrene derivative is preferably used alone, or two or more kinds thereof are preferably used in combination, from the viewpoints of the developing characteristic and durability of the toner. In particular, styrene and n-butyl acrylate are more preferably used in combination because the dielectric constant (∈') is easily improved, the dielectric loss factor (∈") is easily reduced, the moisture absorptivity is also easily reduced, and the fogging under a high-temperature and high-humidity environment can be alleviated.

A polar resin is preferably incorporated into the polymerizable monomer composition. In the suspension polymerization method, the toner particles are produced in the aqueous medium. Accordingly, the incorporation of the polar resin can form a layer of the polar resin on the surface of each toner particle and hence can provide magnetic toner particles each having a core-shell structure.

The toner particles each preferably have the core-shell structure because of the following reason. A shell can be provided with a shielding effect. As a result, for example, the exposure of the magnetic material to the surfaces of the toner particles can be suppressed, and hence the dielectric loss factor (∈") is easily reduced and the fogging can be alleviated. In addition, when a polyester is used in the shell, a low-acid value polyester is preferably used because the moisture absorptivity of the toner can be reduced, and hence the fogging under a high-temperature and high-humidity environment can be alleviated.

Further, when the polyester is used, the degree of freedom in core design increases and the low temperature offset resistance of the toner is easily improved. For example, increasing the glass transition temperature of the shell can reduce the glass transition temperature of a core. In addition, providing the shell with the shielding effect enables a reduction in molecular weight of the core and the incorporation of a large amount of a release agent into the core, and hence easily improves the low temperature offset resistance.

Examples of the polar resin for the shell include: homopolymers of styrene and substituted products thereof, such as polystyrene and polyvinyltoluene; styrene-based copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate copolymer; and polymethyl methacrylate, polybutyl methacrylate, polyvinyl acetate, polyethylene, polypropylene, polyvinyl butyral, a silicone resin, a polyester resin, a styrene-polyester copolymer, a polyacrylate-polyester copolymer, a polymethacrylate-polyester copolymer, a polyamide resin, an epoxy resin, a polyacrylic acid resin, a terpene resin, and a phenol resin. One kind of those resins may be used alone, or two or more kinds thereof may be used in combination. In addition, the following functional group may be introduced into the polymer: an amino group, a carboxyl group, a hydroxyl group, a sulfonic group, a glycidyl group, a nitrile group, or the like. Of those resins, a polyester resin is preferred.

As the polyester resin, a saturated polyester resin or an unsaturated polyester resin, or, as required, both the resins may be selected and used.

A general polyester resin formed of an alcohol component and an acid component may be used as the polyester resin to be used in the present invention, and both the components are exemplified below.

As a dihydric alcohol component, there is given, for example, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octanediol, cyclohexenedimethanol, hydrogenated bisphenol A, a bisphenol derivative represented by the following formula (I):

(I)

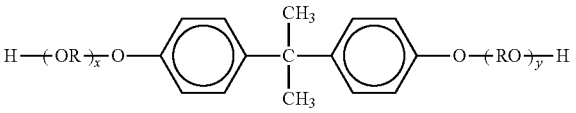

(where R represents an ethylene or propylene group, x and y each represent an integer of 1 or more, and the average value of x+y is 2 or more and 10 or less) or a hydrogenated product of the compound represented by the formula (I), or a diol represented by the following formula (II) or a diol of a hydrogenated product of the compound represented by the formula (II):

(II)

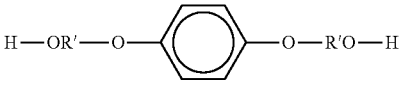

[where R′ represents $-CH_2CH_2-$,

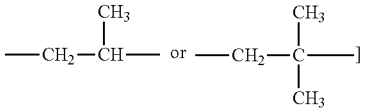

The dihydric alcohol component is particularly preferably an alkylene oxide adduct of bisphenol A described above that is excellent in charging characteristic and environmental stability, and whose other electrophotographic characteristics are balanced. In the case of the compound, the average addition number of moles of the alkylene oxide is preferably 2 or more and 10 or less in terms of the fixability and durability of the toner. In particular, the average addition number of moles of the alkylene oxide is more preferably 2. When the average addition number of moles is 2, the composition distribution of the alkylene oxide easily becomes uniform. Accordingly, the reactivity of the alcohol component with the acid component is uniformized, the composition of the polyester can be uniformized, and the glass transition temperature is easily increased.

As a divalent acid component, there are given, for example: benzenedicarboxylic acids or anhydrides thereof such as phthalic acid, terephthalic acid, isophthalic acid, and phthalic anhydride; alkyldicarboxylic acids such as succinic acid, adipic acid, sebacic acid, and azelaic acid or anhydrides thereof, as well as succinic acid substituted by an alkyl or alkenyl group having 6 to carbon atoms or an anhydride thereof; and unsaturated dicarboxylic acids such as fumaric acid, maleic acid, citraconic acid, and itaconic acid or anhydrides thereof.

Further, a tri- or higher hydric alcohol component may be exemplified by glycerin, pentaerythritol, sorbitol, sorbitan, and an oxyalkylene ether of a novolac-type phenol resin. An tri- or higher valent acid component may be exemplified by trimellitic acid, pyromellitic acid, 1,2,3,4-butanetetracarboxylic acid, and benzophenonetetracarboxylic acid or anhydrides thereof.

Of those acid components, terephthalic acid is preferred because the glass transition temperature is easily increased.

It is preferred that the alcohol component account for 45 mol % or more and 55 mol % or less of all components of the polyester resin in the present invention, and the acid component account for 45 mol % or more and 55 mol % or less thereof.

Although the polyester resin in the present invention can be produced by using any catalyst such as a tin-based catalyst, an antimony-based catalyst, or a titanium-based catalyst, the titanium-based catalyst is preferably used as described in the foregoing.

In addition, the number average molecular weight of the polar resin for the shell is preferably 2,500 or more and 25,000 or less from the viewpoints of developability, blocking resistance, durability, and low-temperature fixability. It should be noted that the number average molecular weight can be measured by GPC.

The resin for forming the shell is preferably a polyester-based resin having an acid value of 0.1 mgKOH/g or more and 5.0 mgKOH/g or less.

When the acid value of the polar resin for the shell is 0.1 mgKOH/g or more, a uniform shell is easily formed and hence the composition of the surface of each toner particle is easily uniformed. Accordingly, the toner can be uniformly charged in the regulating portion and the fogging is easily alleviated. In addition, the uniform shell can be formed and hence the exposure of the magnetic material is easily suppressed. Accordingly, the dielectric loss factor (∈") is easily reduced and the fogging can be alleviated.

In addition, when the acid value is 5.0 mgKOH/g or less, an interaction between the magnetic material and the shell is so small that the agglomeration property of the magnetic material is easily suppressed. Accordingly, the dispersibility of the magnetic material in the toner particles or between the toner particles is easily improved, the dielectric loss factor (∈") is easily reduced, and the attenuation of charge in the developing portion is easily suppressed. Accordingly, the fogging is easily alleviated. In addition, when the acid value is 5 mgKOH/g or less, the moisture absorptivity of the toner under a high-temperature and high-humidity environment is easily reduced, and hence its chargeability easily improves.

The glass transition temperature (Tg) of the resin for forming the shell is preferably 60° C. or more, more preferably 75° C. or more. When the glass transition temperature (Tg) is 60° C. or more, the strength of the shell increases and hence the strength of the toner itself increases. Accordingly, the durable developability of the toner over a long time period improves. In addition, the strength of the shell increases, and hence the flowability of the toner easily improves, its flowability in the regulating portion improves, the toner is uniformly charged with ease, and the fogging is easily alleviated.

The glass transition temperature (Tg) of the resin for forming the shell can be known through measurement with a differential scanning calorimeter (DSC).

The polar resin for the shell is incorporated in an amount of preferably 2 parts by mass or more and 20 parts by mass or less, more preferably 5 parts by mass or more and 15 parts by mass or less with respect to 100 parts by mass of the binder resin. An amount of 2 parts by mass or more is preferred because of the following reason. The shielding effect of the shell improves and hence the exposure of the magnetic material is easily suppressed. Accordingly, the dielectric loss factor (∈") is easily reduced and the fogging can be alleviated. An amount of 5 parts by mass or more makes the foregoing effect additionally significant. An amount of 20 parts by mass or less is preferred because the charge-up of the toner hardly occurs upon its triboelectric charging in the regulating portion and hence a reduction in density due to the charge-up is easily suppressed. An amount of 15 parts by mass or less is more preferred because the reduction in density due to the charge-up can be additionally suppressed.

The polymerization initiator to be used in the production of the toner to be used in the present invention by a polymerization method preferably has a half-life at the time of a polymerization reaction of 0.5 hour or more and 30.0 hours or less. In addition, when the polymerization reaction is performed by using the polymerization initiator in an addition amount of 0.5 part by mass or more and 20.0 parts by mass or less with respect to 100 parts by mass of the polymerizable monomer, a desired strength and an appropriate melting characteristic can be imparted to the toner.

Specific examples of the polymerization initiator include: an azo-based or diazo-based polymerization initiator such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, or azobisisobutyronitrile; and a peroxide-based polymerization initiator such as benzoly peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate, or t-butyl peroxypivalate.

When the toner to be used in the present invention is produced by the polymerization method, a crosslinking agent may be added, and a preferred addition amount thereof is 0.01 part by mass or more and 5.00 parts by mass or less with respect to 100 parts by mass of the polymerizable monomer.

Here, a compound having two or more polymerizable double bonds is mainly used as the crosslinking agent. For example, one kind of the following compounds is used alone, or two or more kinds thereof are used as a mixture: aromatic divinyl compounds such as divinylbenzene and divinylnaphthalene; carboxylic acid esters each having two double bonds such as ethylene glycol diacrylate, ethylene glycol dimethacrylate, and 1,3-butanediol dimethacrylate; divinyl compounds such as divinylaniline, divinyl ether, divinyl sulfide, and divinyl sulfone; and compounds each having three or more vinyl groups.

In the method of producing the toner to be used in the present invention by the polymerization method, as required, the toner composition and the like are added, and are uniformly dissolved or dispersed with a dispersing machine to provide a polymerizable monomer composition. Examples of the dispersing machine include a homogenizer, a ball mill, and an ultrasonic dispersing machine. The resultant polymerizable monomer composition is suspended in an aqueous medium containing a dispersion stabilizer. At this time, the composition is desirably shaped into a desired toner particle size in one stroke by using a high-speed dispersing machine such as a high-speed stirring machine or an ultrasonic dispersing machine because the particle diameters of toner particles to be obtained become sharp. With regard to the timing at which the polymerization initiator is added, the polymerization initiator may be added simultaneously with the addition of any other additive to the polymerizable monomer, or may be mixed immediately before the suspension in the aqueous medium. The polymerization initiator can also be added immediately after granulation and before the initiation of the polymerization reaction.

After the granulation, it is sufficient to perform, with an ordinary stirring machine, such stirring that a particle state is maintained, and the floating and sedimentation of the particles are prevented.

When the toner to be used in the present invention is produced, various surfactants, organic dispersants, and inorganic dispersants can each be used as the dispersion stabilizer. Of those, an inorganic dispersant can be preferably used because the dispersant hardly produces harmful ultrafine powder and obtains dispersion stability through its steric hindrance property. Examples of such inorganic dispersant include: phosphoric acid polyvalent metal salts such as tricalcium phosphate, magnesium phosphate, aluminum phosphate, zinc phosphate, and hydroxyapatite; carbonic acid salts such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

Such inorganic dispersant is desirably used in an amount of 0.2 part by mass or more and 20.0 parts by mass or less with respect to 100 parts by mass of the polymerizable monomer. In addition, one kind of the dispersion stabilizers may be used alone, or two or more kinds thereof may be used in combination. Further, a surfactant may be used in combination.

In the step of polymerizing the polymerizable monomer, a polymerization temperature is set to 40° C. or more, or in general, to a temperature of 50° C. or more and 90° C. or less. When the polymerization is performed in the temperature range, the release agent to be sealed in the toner is deposited by phase separation and hence the inclusion becomes additionally complete.

After the completion of the polymerization of the polymerizable monomer, the resultant polymer particles are filtered, washed, and dried to provide toner particles. The toner particles are mixed with such inorganic fine particles as described later as required so that the inorganic fine particles may adhere to the surfaces of the toner particles. Thus, a toner can be obtained. In addition, coarse powder or fine powder in the toner particles can be cut off by including a classifying step in the production process (before the mixing of the inorganic fine particles).

In addition, it is preferred that inorganic fine particles having a number average primary particle diameter of 4 nm or more and 80 nm or less, more preferably from 6 nm to 40 nm be added (externally added) as a fluidizer to the toner particles of the toner of the present invention. Although the inorganic fine particles are added for improving the flowability of the toner and uniformizing the charging of the toner particles, the following mode is also preferred: functions such as the adjustment of the charge quantity of the toner and an improvement in environmental stability of the toner are imparted by the treatment of the inorganic fine particles such as hydrophobic treatment.

In the present invention, the measurement of the number average primary particle diameter of the inorganic fine particles is performed with a photograph of the toner photographed with a scanning electron microscope at a certain magnification.

Fine particles of silica, titanium oxide, alumina, or the like can be used as the inorganic fine particles to be used in the present invention. Examples of the silica fine particles include dry silica, which is so-called dry process silica or fumed silica, produced by the vapor phase oxidation of a silicon halide and the so-called wet silica produced from water glass and the like.

However, the dry silica is preferred because the number of silanol groups present on its surface and in the silica fine particles is small, and the amount of a production residue such as $Na_2O$ or $SO_3^{2-}$ is small. In addition, in the dry silica, composite fine particles of silica and any other metal oxide can also be obtained by using, in its production process, any other metal halide such as aluminum chloride or titanium chloride together with the halogenated silicon compound. The composite fine particles are also included in the dry silica.

The addition amount of the inorganic fine particles having a number average primary particle diameter of 4 nm or more and 80 nm or less is preferably from 0.1 mass % to 3.0 mass % with respect to the toner particles. The content of the inorganic fine particles can be determined by using a calibration curve produced from a standard sample by employing fluorescent X-ray analysis.

In the present invention, the inorganic fine particles are preferably subjected to hydrophobic treatment because the environmental stability of the toner can be improved. Examples of the treatment agents to be used in the hydrophobic treatment of the inorganic fine particles include a silicone varnish, various modified silicone varnishes, a silicone oil, various modified silicone oils, a silane compound, and a silane coupling agent. In addition, the examples include treatment agents such as other organic silicon compounds and organic titanium compounds. One kind of those treatment agents may be used alone, or two or more kinds thereof may be used in combination.

Of the treatment agents, a silicone oil is preferably used in the treatment, and the inorganic fine particles are more preferably treated with the silicone oil simultaneously with the hydrophobic treatment thereof with the silane compound or after the treatment. A method for such treatment of the inorganic fine particles can be, for example, as follows: as a first-stage reaction, a silylation reaction is performed with the silane compound to cause a silanol group to disappear by virtue of a chemical bond, and then, as a second-stage reaction, hydrophobic thin films are formed from the silicone oil on the surfaces of the inorganic fine particles.

The silicone oil has a viscosity at 25° C. of preferably 10 $mm^2/s$ or more and 200,000 $mm^2/s$ or less, more preferably 3,000 $mm^2/s$ or more and 80,000 $mm^2/s$ or less.

For example, dimethyl silicone oil, methyl phenyl silicone oil, α-methylstyrene-modified silicone oil, chlorophenyl silicone oil, or fluorine-modified silicone oil is particularly preferred as the silicone oil to be used.

Examples of a method of treating the inorganic fine particles with the silicone oil include: a method involving directly mixing the inorganic fine particles treated with the silane compound and the silicone oil by using a mixer such as a Henschel mixer; and a method involving spraying the inorganic fine particles with the silicone oil. Also permitted is a method involving: dissolving or dispersing the silicone oil in an appropriate solvent; adding the inorganic fine particles to the resultant; mixing the contents; and removing the solvent. The method involving the spraying is more preferred because the production of an agglomerate of the inorganic fine particles is relatively suppressed.

100 Parts by mass of the inorganic fine particles are treated with preferably 1 part by mass to 40 parts by mass, more preferably 3 parts by mass to 35 parts by mass of the silicone oil because such treatment amount easily provides good hydrophobicity.

The specific surface area of the inorganic fine particles to be used in the present invention measured by a BET method based on nitrogen adsorption falls within the range of preferably from 20 $m^2/g$ to 350 $m^2/g$, more preferably from 25 $m^2/g$ to 300 $m^2/g$ in order that good flowability may be imparted to the toner. The specific surface area is calculated as described below. The surface of the sample is caused to adsorb a nitrogen gas by using a specific surface area-measuring apparatus AUTOSORB 1 (manufactured by Yuasa Ionics) in accordance with the BET method, and the specific surface area is calculated by employing a BET multipoint method.

Further, as a developability improver, any other additives, for example, the following additives may also be used for the toner of the present invention in a small amount: lubricant particles such as fluororesin particles, zinc stearate particles, and polyvinylidene fluoride particles; polishing agents such as cerium oxide particles, silicon carbide particles, and strontium titanate particles; flowability-imparting agents such as titanium oxide particles and aluminum oxide particles; an anticaking agent; and organic fine particles and inorganic fine particles opposite in polarity to the toner particles. The additive may be used by subjecting its surface to hydrophobic treatment.

Next, the toner carrier to be used in the present invention is described.

The toner carrier to be used in the present invention includes a substrate, an elastic layer, and a surface layer containing a urethane resin, and the urethane resin has a partial structure derived from a reaction between a compound represented by the structural formula (1) and a polyisocyanate.

FIG. 1 illustrates a toner carrier according to one embodiment of the present invention.

A conductive roller 1 (toner carrier) illustrated in FIG. 1 is obtained by forming an elastic layer 3 so as to cover the outer peripheral surface of a columnar or hollow cylindrical conductive substrate 2. In addition, a surface layer 4 is formed so as to cover the outer peripheral surface of the elastic layer 3.

<Substrate>

The substrate 2 functions as an electrode and support member for the conductive roller 1, and is constituted of a conductive material such as: a metal or an alloy like aluminum, a copper alloy, or stainless steel; iron subjected to plating treatment with chromium or nickel; or a synthetic resin having conductivity.

<Elastic Layer>

The elastic layer 3 imparts, to the conductive roller, elasticity needed for forming an abutting portion having a predetermined width in an abutting portion between the conductive roller 1 and the electrostatic latent image bearing member.

It is preferred that the elastic layer 3 be formed of a rubber material.

Examples of the rubber material include an ethylene-propylene-diene copolymerized rubber (EPDM), an acrylonitrile-butadiene rubber (NBR), a chloroprene rubber (CR), a natural rubber (NR), an isoprene rubber (IR), a styrene-butadiene rubber (SBR), a fluororubber, a silicone rubber, an epichlorohydrin rubber, a hydrogenated product of NBR, and a urethane rubber. One kind of those materials may be used alone, or two or more kinds thereof may be used in combination.

Of those, a silicone rubber is preferred because a compression set hardly occurs in the elastic layer even when any other member (such as a regulating member (regulating blade)) abuts therewith over a long time period. The silicone rubber is, for example, a cured product of an addition-curable silicone rubber. Moreover, a cured product of an addition-curable dimethyl silicone rubber is more preferred because of its excellent adhesive property to the surface layer to be described later.

Various additives such as a conductivity-imparting agent, a nonconductive filler, a crosslinking agent, and a catalyst may each be incorporated into the elastic layer 3 as required. Examples of the conductivity-imparting agent include: carbon black; fine particles of a conductive metal such as aluminum or copper; and fine particles of a conductive metal oxide such as zinc oxide, tin oxide, or titanium oxide. Of those, carbon black is preferred because the carbon black is relatively easily available and provides good conductivity.

When the carbon black is used as the conductivity-imparting agent, the carbon black is blended in an amount of 2 parts by mass or more and 50 parts by mass or less with respect to 100 parts by mass of the rubber in the rubber material.

Examples of the nonconductive filler include particles of silica, quartz, titanium oxide, zinc oxide, and calcium carbonate.

Examples of the crosslinking agent include di-t-butyl peroxide, 2,5-dimethyl-2,5-di(t-butylperoxy)hexane, and dicumyl peroxide.

Any of various catalysts that are generally used can be used as the catalyst.

<Surface Layer>

The surface layer 4 is a resin layer using a urethane resin as a main component. The urethane resin is obtained by a reaction between a polyol and a polyisocyanate. Specifically, the urethane resin can be synthesized as described below.

First, a polyol component such as a polyether polyol or a polyester polyol and the polyisocyanate are caused to react with each other to provide an isocyanate group-terminated prepolymer.

Next, the isocyanate group-terminated prepolymer is caused to react with a compound having a structure represented by the structural formula (1), whereby the urethane resin according to the present invention can be obtained.

Examples of the polyether polyol include polyethylene glycol, polypropylene glycol, and polytetramethylene glycol.

Examples of the polyester polyol include polyester polyols each obtained by a condensation reaction of a diol component such as 1,4-butanediol, 3-methyl-1,4-pentanediol, or neopentyl glycol, a triol component such as trimethylolpropane, and a dicarboxylic acid such as adipic acid, phthalic anhydride, terephthalic acid, or hexahydroxyphthalic acid.

In addition to those described above, examples of the polyol component include a polyolefin polyol such as polybutadiene polyol or polyisoprene polyol and a hydrogenated product thereof, and polycarbonate polyol.

The polyol component may be formed in advance into a prepolymer through chain extension with an isocyanate such as 2,4-tolylene diisocyanate (TDI), 1,4-diphenylmethane diisocyanate (MDI), or isophorone diisocyanate (IPDI) as required.

The number average molecular weight of each of the polyether polyol and the polyester polyol is preferably 1,000 or more and 4,000 or less. When the number average molecular weight of any such polyol is 1,000 or more and 4,000 or less, the amount of a hydroxyl group with respect to the molecular weight is large, and hence the polyol shows high reactivity with the isocyanate and the amount of an unreacted component reduces. Accordingly, the chargeability of the toner carrier in a high-temperature and high-humidity environment becomes additionally good.

Examples of the isocyanate compound to be caused to react with the polyol component and the compound represented by the structural formula (1) include: aliphatic polyisocyanates such as ethylene diisocyante and 1,6-hexamethylene diisocyante (HDI); alicyclic polyisocyanates such as isophorone diisocyanate (IPDI), cyclohexane 1,3-diisocyanate, and cyclohexane 1,4-diisocyanate; and aromatic isocyanates such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate. In addition, copolymers thereof, isocyanurates thereof, TMP adducts thereof, biuret compounds thereof, and blocked compounds thereof can also be used.

Of those, aromatic isocyanates such as tolylene diisocyanate, diphenylmethane diisocyanate, and polymeric diphenylmethane diisocyanate are preferred.

The mixing ratio of the isocyanate compound to be caused to react with the polyol component and the compound represented by the structural formula (1) in terms of an isocyanate group ratio is preferably 1.0 or more and 2.0 or less with respect to 1.0 of a hydroxyl group of each of the polyol component and the compound.

The compound represented by the structural formula (1) is used in the surface layer of the toner carrier to be used in the present invention. As described so far, the use of the compound can impart high chargeability to the toner. Further, the use facilitates the suppression of the charge loss of the toner in the developing portion and can alleviate the fogging.

Structural formula (1)

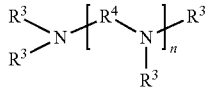

The compound represented by the structural formula (1) is described in detail. The compound represented by the structural formula (1) represents a polyfunctional polyol or terminal amino compound having an amine structure in a molecule thereof.

When n in the structural formula (1) represents 1 or more and 4 or less, i.e., when the compound has a structure having 4 or more and 7 or less hydroxyl groups or amino groups as reactive functional groups, a crosslinked structure based on a urethane group or a urea group is satisfactorily formed, and hence the microscopic hardness of the compound increases. As a result, the contact area of the developing portion where the electrostatic latent image bearing member and the toner carrier abut with each other can be reduced. Accordingly, the area where the toner receives the electric field in the developing portion reduces and hence the charge loss of the toner is easily suppressed.

Next, according to studies made by the inventors of the present invention, the effect is exhibited when the number of the hydroxyl groups or amino groups of the compound represented by the structural formula (1) is 4 or more and 7 or less. Accordingly, the number of the terminal functional groups of the compound represented by the structural formula (1) only needs to be at least 4, and the same effect is obtained even when the other groups are substituted with alkyl groups.

In the structural formula (1), $R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the structural formula (2).

When $R^3$ represents a hydroxyalkyl group, the number of its carbon atoms is preferably 1 or more and 8 or less, and when $R^3$ represents an aminoalkyl group, the number of its carbon atoms is preferably 2 or more and 8 or less because the crosslinked structure based on a urethane group or urea group is easily formed.

The structural formula (2) represents a group whose terminal is a hydroxyl group, the group having the so-called ether repeating unit. In the case where $R^3$ represents a group represented by the structural formula (2) as well, by the same reason, it is preferred that $R^5$ represent an alkylene group having 2 or more and 5 or less carbon atoms, and an ether repetition number m is 2 or 3.

Structural formula (2)

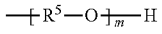

In the structural formula (1), $R^4$ represents an alkylene group having 2 or more and 4 or less carbon atoms. When $R^4$ represents an alkylene group having 2 or more and 4 or less carbon atoms, the chargeability of the toner carrier improves. This is probably because when $R^4$ represents the alkylene group having 2 or more and 4 or less carbon atoms, a molecule of the compound has a moderate size and hence its dispersibility at the time of its reaction with the isocyanate becomes good.

Of the compounds represented by the structural formula (1), a compound represented by the structural formula (3) is preferred. That is, it is preferred that in the structural formula (1), n represent 1 or 2, $R^3$'s each independently represent an alkylene group having 2 or 3 carbon atoms, and $R^4$ represent an alkylene group having 2 carbon atoms.

A urethane resin including a partial structure derived from the structural formula (3) having a functional group value of 5 (pentafunctional) is preferred because a distance between urethane groups falls within the most suitable range, and hence the rolling property of the toner in the regulating portion becomes good.

Structural formula (3)

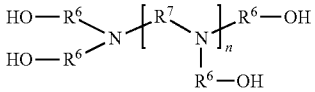

(In the structural formula (3), n represents 1 or 2, $R^6$'s each independently represent an alkylene group having 2 or 3 carbon atoms, and $R^7$ represents an alkylene group having 2 carbon atoms.)

It should be noted that in the present invention, when $R^3$ represents (a) a hydroxyalkyl group having 2 or more and 8 or less carbon atoms, or (c) a group represented by the structural formula (2), the structure formed by the reaction between the compound represented by the structural formula (1) and the polyisocyanate becomes a structure having a urethane group at a terminal of the structural formula (1).

In addition, when $R^3$ represents (b) an aminoalkyl group having 1 or more and 8 or less carbon atoms, the structure becomes a structure having a urea group at a terminal of the structural formula (1).

The surface layer 4 preferably has conductivity. A method of imparting the conductivity is, for example, the addition of an ion conductive agent or conductive fine particles to the surface layer 4. Of those, conductive fine particles that are available at a low cost and show a small variation in resistance due to an environment are preferred, and in particular, carbon black is more preferred from the viewpoints of conductivity-imparting property and reinforcing property. The conductive fine particles are preferably carbon black having a primary particle diameter of 18 nm or more and 50 nm or less, and a DBP oil absorption of 50 mL/100 g or more and 160 mL/100 g or less because a balance among its conductivity, hardness, and dispersibility is good. The content of the conductive fine particles is preferably 10 mass % or more and 30 mass % or less with respect to 100 parts by mass of the resin component forming the surface layer.

When the toner carrier is required to have a surface roughness, fine particles for roughness control may be added to the surface layer 4. The fine particles for roughness control preferably have a volume average particle diameter of 3 μm or more and 20 μm or less. In addition, the addition amount of the particles to be added to the surface layer is preferably 1 part by mass or more and 50 parts by mass or less with respect to 100 parts by mass of the resin solid content of the surface layer. Fine particles of a polyurethane resin, a polyester resin, a polyether resin, a polyamide resin, an acrylic resin, a phenol resin, or the like can be used as the fine particles for roughness control.

A method of forming the surface layer 4 is, for example, spray coating, dip coating, or roll coating with a paint. As a method of forming the surface layer, such a dip coating method involving overflowing the paint from the upper end of a dipping tank as described in Japanese Patent Application Laid-Open No. S57-005047 is simple and excellent in production stability.

Next, the developing apparatus of the present invention is described in detail with reference to the drawings.

Figure 2:
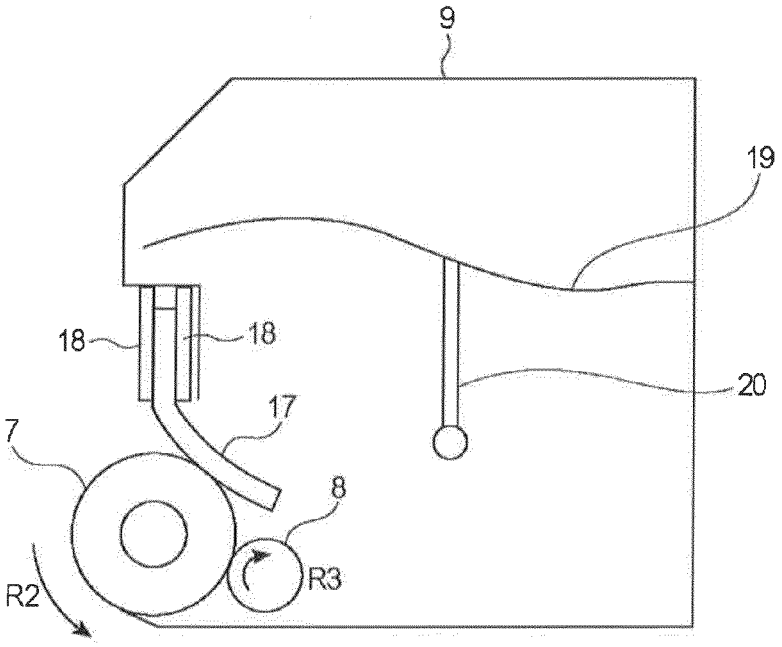
FIG. 2 is a schematic sectional view illustrating an example of a developing apparatus according to the present invention.

FIG. 2 is a schematic sectional view illustrating an example of the developing apparatus of the present invention. In addition, FIG. 3 is a schematic sectional view illustrating an example of an image-forming apparatus having built therein the developing apparatus of the present invention.

Figure 3:
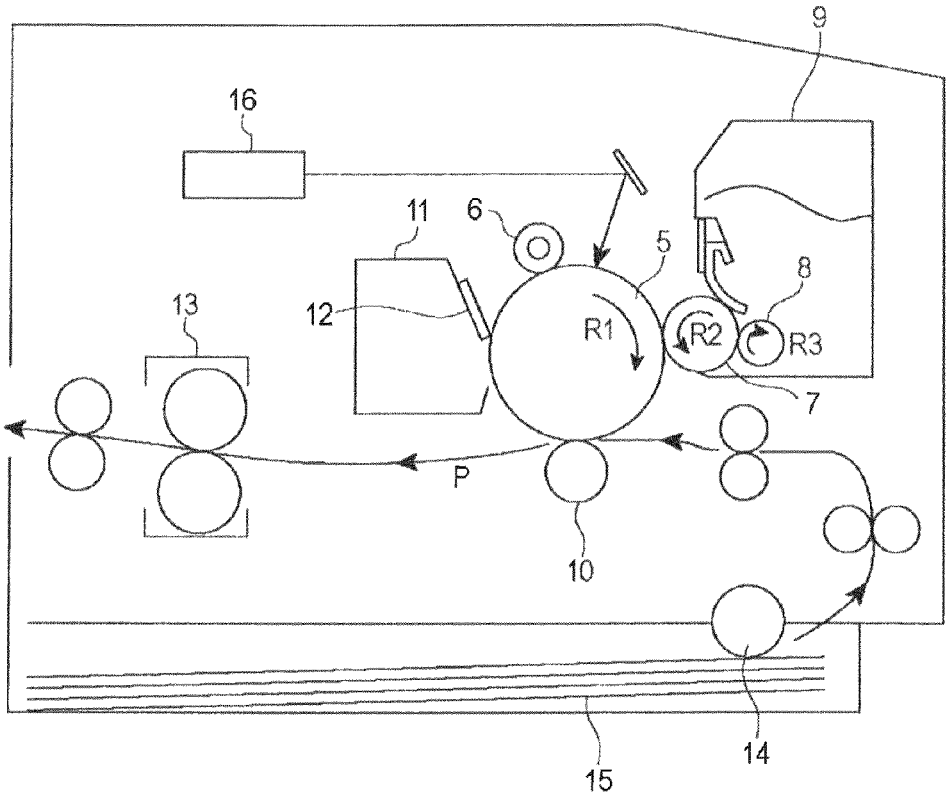
FIG. 3 is a schematic sectional view illustrating an example of an image-forming apparatus including the developing apparatus according to the present invention.

In FIG. 2 or FIG. 3, an electrostatic latent image bearing member 5 having formed thereon an electrostatic latent image is rotated in a direction indicated by an arrow R1. A toner carrier 7 rotates in a direction indicated by an arrow R2 to convey toner 19 to a development area where the toner carrier 7 and the electrostatic latent image bearing member 5 are opposite to each other. In addition, a toner-supplying member 8 is brought into contact with the toner carrier and rotates in a direction indicated by an arrow R3 to supply the toner 19 to the surface of the toner carrier.

Provided around the electrostatic latent image bearing member 5 are, for example, a charging roller 6, a transferring member (transfer roller) 10, a cleaner container 11, a cleaning blade 12, a fixing apparatus 13, and a pickup roller 14. The electrostatic latent image bearing member 5 is charged by the charging roller 6. Then, exposure (image exposure) is performed by irradiating the electrostatic latent image bearing member 5 with laser light (image exposure light) from a laser generator (image exposure apparatus) 16, whereby an electrostatic latent image corresponding to a target image is formed. The electrostatic latent image on the electrostatic latent image bearing member 5 is developed with toner in a developing apparatus 9 to provide a toner image. The toner image is transferred onto a transfer material (paper) 15 by the transferring member (transfer roller) 10 brought into abutment with the electrostatic latent image bearing member 5 through the transfer material. The transfer of the toner image onto the transfer material may be performed through an intermediate transfer member. The transfer material (paper) 15 onto which the toner image has been mounted is conveyed to the fixing apparatus 13 where the image is fixed onto the transfer material (paper) 15. In addition, the toner 19 remaining partially on the electrostatic latent image bearing member 5 is scraped off by the cleaning blade 12 and stored in the cleaner container 11.

Preferably used in a charging step in the developing apparatus of the present invention is such a contact charging apparatus that the electrostatic latent image bearing member and the charging roller are brought into contact with each other while forming an abutting portion, and a predetermined charging bias is applied to the charging roller to charge the surface of the electrostatic latent image bearing member to a predetermined potential having predetermined polarity. When contact charging is performed as described above, stable and uniform charging can be performed, and the generation of ozone can be reduced. In addition, a charging roller that rotates in the same direction as that of the electrostatic latent image bearing member is more preferably used in order that its contact with the electrostatic latent image bearing member may be kept uniform and uniform charging may be performed.

Preferred process conditions at the time of the use of the charging roller can be, for example, as follows: a direct-current voltage or a voltage obtained by superimposing an alternating voltage on the direct-current voltage is applied at an abutting pressure of the charging roller of 4.9 N/m or more and 490.0 N/m or less.

The alternating voltage has a peak-to-peak voltage of preferably 0.5 kVpp or more and 5.0 kVpp or less, and an alternating frequency of preferably 50 Hz or more and 5 kHz or less. The direct-current voltage has a voltage absolute value of preferably 400 V or more and 1,700 V or less.

As an elastic material as a material for the charging roller, there are given, for example: a rubber material obtained by dispersing a conductive substance for resistance adjustment such as carbon black or a metal oxide in ethylene-propylene-diene polyethylene (EPDM), urethane, a butadiene-acrylonitrile rubber (NBR), a silicone rubber, or an isoprene rubber; and a foamed product thereof. In addition, the resistance adjustment can be performed by using an ion conductive material without dispersing the conductive substance or in combination with the conductive substance.

In addition, a mandrel to be used in the charging roller is, for example, aluminum or SUS. The charging roller is placed while being brought into press contact with the electrostatic latent image bearing member as a member to be charged with a predetermined pressing force. Thus, a charging abutting portion as an abutting portion between the charging roller and the electrostatic latent image bearing member is formed.

Next, a contact transferring step to be preferably utilized in the present invention is specifically described.

In the contact transferring step, a toner image is electrostatically transferred onto a recording medium while the electrostatic latent image bearing member abuts with the transferring member having applied thereto a voltage opposite in polarity to the toner through the recording medium. The abutting pressure of the transferring member is preferably 2.9 N/m or more, more preferably 19.6 N/m or more in terms of a linear pressure. When the linear pressure as the abutting pressure is 2.9 N/m or more, the conveyance shift of the recording medium or a transfer failure hardly occurs.

In the present invention, a regulating member preferably abuts with the toner carrier through the toner to regulate the thickness of a toner layer on the toner carrier. With such construction, a high-quality image suppressed in fogging can be obtained. The regulating member that abuts with the toner carrier is generally a regulating blade and the blade can be suitably used in the present invention as well.

A rubber elastic body such as a silicone rubber, a urethane rubber, or a NBR, a synthetic resin elastic body such as polyethylene terephthalate, or a metal elastic body such as a phosphor bronze plate or a SUS plate can be used as the regulating blade, and a composite of two or more kinds thereof is also permitted. Further, a product obtained as follows may be used: a charging control substance such as a resin, a rubber, a metal oxide, or a metal is attached for the purpose of controlling the chargeability of the toner to an elastic support such as the rubber, synthetic resin, or metal elastic body so as to be brought into contact with a portion of the support abutting with the toner carrier. Of those, a product obtained as follows is preferred: a resin or a rubber is attached to the metal elastic body so as to be brought into contact with a portion of the elastic body abutting with the toner carrier.

A material for the member to be attached to the metal elastic body is preferably a material that is easily charged to positive polarity such as a urethane rubber, a urethane resin, a polyamide resin, or a nylon resin.

A base portion as an upper side portion side of the regulating blade is fixed and held on a developing apparatus side, and a lower side portion side thereof is brought into abutment with the surface of the toner carrier with a moderate elastic pressing force while being brought into a curved state in the forward direction or reverse direction of the toner carrier against the elastic force of the blade.

An abutting pressure between the regulating blade and the toner carrier is preferably 1.30 N/m or more and 245.0 N/m or less, more preferably 4.9 N/m or more and 118.0 N/m or less in terms of a linear pressure in the bus direction of the toner carrier. When the abutting pressure is 1.30 N/m or more, the toner can be more uniformly applied, and hence fogging or scattering is less liable to occur. When the abutting pressure is 245.0 N/m or less, a large pressure is hardly applied to the toner and hence the deterioration of the toner is less liable to occur.

The amount of the toner layer on the toner carrier is preferably 2.0 $g/m^2$ or more and 15.0 $g/m^2$ or less, more preferably 3.0 $g/m^2$ or more and 14.0 $g/m^2$ or less.

When the amount of the toner (toner layer) on the toner carrier is 2.0 $g/m^2$ or more, a sufficient image density is easily obtained. When the amount of the toner on the toner carrier is 15.0 $g/m^2$ or less, uniform chargeability is easily obtained, and hence the fogging can be more suppressed.

It should be noted that in the present invention, the amount of the toner on the toner carrier can be changed by changing the surface roughness (Ra) of the toner carrier, the free length of the regulating blade, and the abutting pressure of the regulating blade.

A method of measuring the amount of the toner on the toner carrier is as described below. First, a thimble is mounted on a suction opening having an outer diameter of 6.5 mm. The resultant is attached to a cleaner, and the toner on the toner carrier is sucked while the thimble is aspirated. A value obtained by dividing the amount (g) of the sucked toner by the sucked area ($m^2$) is regarded as the amount of the toner on the toner carrier.

In the present invention, the outer diameter of the toner carrier carrying the toner is preferably 8.0 mm or more and 14.0 mm or less. The outer diameter of the toner carrier is desirably as small as possible from the viewpoint of reducing the developing apparatus in size. However, the outer diameter is desirably as large as possible from the viewpoints of good developability and the suppression of the fogging.

The surface roughness of the toner carrier to be used in the present invention is preferably 0.3 μm or more and 5.0 μm or less, more preferably 0.5 μm or more and 4.5 μm or less in terms of a center line average roughness Ra in the standard of JIS B 0601:1994 "Surface Roughness".

When the Ra is 0.3 μm or more and 5.0 μm or less, the conveyance amount of the toner is sufficiently obtained, and the amount of the toner on the toner carrier can be easily regulated and hence a regulation failure hardly occurs. In addition, the charge quantity of the toner easily becomes uniform.

The center line average roughness Ra of the surface of the toner carrier in the standard of JIS B 0601:1994 "Surface Roughness" is measured with a SURFCORDER SE-3500 manufactured by Kosaka Laboratory Ltd. Nine points (three points in a circumferential direction for each of three points taken at an equal interval in an axial direction) were subjected to the measurement under the measurement conditions of a cutoff of 0.8 mm, an evaluation length of 4 mm, and a feeding speed of 0.5 mm/s, and the average of the nine measured values was calculated.

The surface roughness of the toner carrier in the present invention can be caused to fall within the range by, for example, a method involving changing the polished state of the surface layer of the toner carrier, or incorporating spherical carbon particles, carbon fine particles, graphite, resin fine particles, or the like into the surface layer.

In the present invention, a developing step is preferably a step of applying a developing bias to the toner carrier to cause the toner to transfer to an electrostatic latent image on the electrostatic latent image bearing member to form a toner image. The developing bias may be a direct-current voltage or may be a voltage obtained by superimposing an alternating voltage on the direct-current voltage.

For example, a sinusoidal wave, a rectangular wave, or a triangular wave is given as the waveform of the alternating voltage. A pulse wave formed by periodically turning a direct-current power supply on and off can also be used. As described above, a bias whose voltage value periodically changes can be used as the waveform of the alternating voltage.

Figure 4:
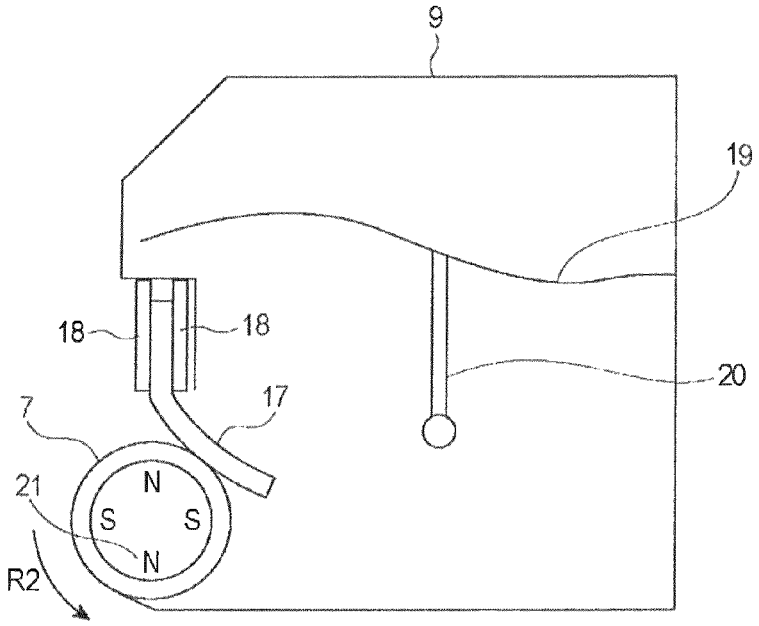
FIG. 4 is a schematic sectional view illustrating an example of the developing apparatus according to the present invention.

In the case where such a system that the toner is conveyed by magnetism without the use of any toner-supplying member is used in the present invention, a magnet is preferably placed in the toner carrier (reference numeral 21 of FIG. 4). In this case, the toner carrier preferably has a fixed magnet having many magnetic poles in itself, and the magnet preferably has 3 or more and 10 or less magnetic poles.

Next, methods of measuring various physical properties according to the toner to be used in the present invention are described.

<Dielectric Constant (∈') and Dielectric Loss Factor (∈") of Toner>

The dielectric characteristics of the toner according to the present invention are measured by the following methods.

After calibration has been performed with a 4284A Precision LCR Meter (manufactured by Hewlett-Packard Company) at frequencies of 1 kHz and 1 MHz, the dielectric constant (∈') and the dielectric loss factor (∈") are calculated from a measured value for a complex dielectric constant at a frequency of 100 kHz. 1.0 Gram of the toner is weighed, and a load of 19,600 kPa (200 kg/cm$^2$) is applied to the toner for 2 minutes to mold the toner into a disc-like measurement sample having a diameter of 25 mm and a thickness of 1 mm or less (preferably 0.5 mm or more and 0.9 mm or less). The measurement sample is mounted on an ARES (manufactured by Rheometric Scientific F.E.) mounted with a dielectric constant-measuring jig (electrode) having a diameter of 25 mm, and is heated to a temperature of 80° C. to be melted and fixed. After that, the resultant is cooled to a temperature of 25° C. and measured values are obtained as follows: while measured values are taken in at a constant frequency of 100 kHz and a rate of temperature increase of 2° C./min every 15 seconds in a state where a load of 0.49 N (50 g) is applied to the resultant, the resultant is heated to 150° C. The dielectric constant (∈') and dielectric loss factor (∈") of the toner at a temperature of 30° C. are calculated.

<Moisture Adsorption Amount of Toner>

The moisture adsorption amount of the toner in the present invention is measured with an adsorption equilibrium-measuring apparatus ("EAM-02" manufactured by JT Toshi Inc.). The apparatus causes a gas of interest (water in the case of the present invention) to reach solid-gas equilibrium under such a condition that only the gas is present, and measures a solid mass and vapor pressure at this time.

The entire process of actual measurement of an adsorption-desorption isotherm covering the measurement of a dry matter mass and the removal of dissolved air in water described below, and the measurement of the adsorption-desorption isotherm is automatically performed by a computer. The outline of the measurement is described in an operating manual published by JT Toshi Inc., and is as described below. It should be noted that water is used as a solvent liquid in the present invention.

First, about 5 g of the toner are loaded into a sample container in an adsorption tube, and then the temperature of a thermostat and the temperature of a sample portion are set to 30° C. After that, the sample is dried by: opening air valves V1 (main valve) and V2 (exhaust valve); and actuating an evacuating portion to evacuate the inside of a vacuum chamber to about 0.01 mmHg. A mass at the time point when a change in mass of the sample disappears is defined as the "dry matter mass".

Deaeration needs to be performed because air is dissolved in the water as a solvent liquid.

First, the water is charged into a reservoir, the evacuating portion is actuated, and the air valve V2 and an air valve V3 (reservoir valve) are alternately opened and closed to remove the dissolved air. The foregoing operation is repeated several times and the time point when no air bubbles are observed in the water is defined as the completion of the deaeration.

Subsequently to the measurement of the dry matter mass and the removal of the dissolved air in the water, water vapor is introduced from the reservoir by closing the air valves V1 and V2, and opening the air valve V3 while holding a pressure in the vacuum chamber at a vacuum, and then the air valves are closed. Next, the vapor of the solvent is introduced into the vacuum chamber by opening the air valve V1, and its pressure is measured with a pressure sensor. When the pressure in the vacuum chamber does not reach a preset pressure, the pressure in the vacuum chamber is set to the preset pressure by repeating the foregoing operation. As equilibrium is reached, the pressure and mass in the vacuum chamber become constant. Accordingly, the pressure, temperature, and sample mass at that time are measured as equilibrium data.

The adsorption-desorption isotherm can be measured by changing the pressure of the water vapor through the foregoing operations. In the actual measurement, relative vapor pressures at which adsorption amounts are measured are set in advance. When the preset pressures are, for example, 5%, 10%, 30%, 50%, 70%, 80%, 90%, and 95%, an "adsorption process" in the present invention refers to a process in which the isotherm is measured by measuring the moisture adsorption amount in order of increasing relative vapor pressure starting from 5%. In addition, in contrast to the "adsorption process", a "desorption process" to be performed subsequently to the adsorption process refers to a process in which the moisture adsorption amount is measured while the relative vapor pressure is reduced from 95%.

In the apparatus, the pressure is set in terms of a relative vapor pressure (% RH), and the adsorption-desorption isotherm is represented by the adsorption amount and the relative vapor pressure.

<Average Particle Diameter and Particle Size Distribution of Toner>

The weight average particle diameter (D4) of the toner is calculated in the following manner.

As a measuring apparatus, a precision particle size distribution measuring apparatus based on a pore electrical resistance method provided with a 100-μm aperture tube "Coulter Counter Multisizer 3" (trademark, manufactured by Beckman Coulter, Inc.) is used. For setting measurement conditions and analyzing measurement data, dedicated software included with the apparatus "Beckman Coulter Multisizer 3 Version 3.51" (manufactured by Beckman Coulter, Inc.) is used. It should be noted that the measurement is performed with the number of effective measurement channels set to 25,000.

An electrolyte aqueous solution prepared by dissolving special grade sodium chloride in ion-exchanged water to have a concentration of 1 mass %, for example, "ISOTON II" (manufactured by Beckman Coulter, Inc.) can be used in the measurement.

It should be noted that the dedicated software was set as described below prior to the measurement and the analysis.

In the "change standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "threshold/noise level measurement button." In addition, a current is set to 1,600 μA, a gain is set to 2, an electrolyte solution is set to ISOTON II, and a check mark is placed in a check box as to whether "the aperture tube is flushed after the measurement."

In the "setting for conversion from pulse to particle diameter" screen of the dedicated software, a bin interval is set to a logarithmic particle diameter, the number of particle diameter bins is set to 256, and a particle diameter range is set to the range of from 2 μm to 60 μm.

A specific measurement method is as described below.

(1) 200 mL of the electrolyte aqueous solution are charged into a 250-mL round-bottom beaker made of glass dedicated for the Multisizer 3. The beaker is set in a sample stand, and the electrolyte aqueous solution in the beaker is stirred with a stirrer rod at 24 rotations/sec in a counterclockwise direction.

Then, dirt and bubbles in the aperture tube are removed by the "aperture flush" function of the dedicated software.

(2) 30 mL of the electrolyte aqueous solution are charged into a 100-mL flat-bottom beaker made of glass. 0.3 mL of a diluted solution prepared by diluting "Contaminon N" (a 10 mass % aqueous solution of a neutral detergent for washing a precision measuring device formed of a nonionic surfactant, an anionic surfactant, and an organic builder and having a pH 7, manufactured by Wako Pure Chemical Industries, Ltd.) with ion-exchanged water by three mass fold is added as a dispersant to the electrolyte aqueous solution.

(3) An ultrasonic dispersing machine "Ultrasonic Dispension System Tetora 150" (manufactured by Nikkaki Bios Co., Ltd.) in which two oscillators each having an oscillatory frequency of 50 kHz are built so as to be out of phase by 180° and which has an electrical output of 120 W is prepared. 3.3 L of ion-exchanged water are charged into the water tank of the ultrasonic dispersing machine. 2 mL of the Contaminon N are charged into the water tank.

(4) The beaker in the item (2) is set in the beaker fixing hole of the ultrasonic dispersing machine, and the ultrasonic dispersing machine is operated. Then, the height position of the beaker is adjusted in order that the liquid level of the electrolyte aqueous solution in the beaker may resonate with an ultrasonic wave from the ultrasonic dispersing machine to the fullest extent possible.

(5) 10 mg of toner are gradually added to and dispersed in the electrolyte aqueous solution in the beaker in the item (4) in a state in which the electrolyte aqueous solution is irradiated with the ultrasonic wave. Then, the ultrasonic dispersion treatment is continued for an additional 60 seconds. It should be noted that the temperature of water in the water tank is adjusted so as to be 10° C. or more and 40° C. or less upon ultrasonic dispersion.

(6) The electrolyte aqueous solution in the item (5) in which the toner has been dispersed is dropped with a pipette to the round-bottom beaker in the item (1) placed in the sample stand, and the concentration of the toner to be measured is adjusted to 5%. Then, measurement is performed until the particle diameters of 50,000 particles are measured.

(7) The measurement data is analyzed with the dedicated software included with the apparatus, and the weight average particle diameter (D4) is calculated. It should be noted that an "average diameter" on the "analysis/volume statistics (arithmetic average)" screen of the dedicated software when the dedicated software is set to graph/volume % is the weight average particle diameter (D4).

<Method of Measuring Average Circularity of Toner Particles>

The average circularity of the toner particles is measured under measurement and analysis conditions at the time of correction operation with a flow-type particle image analyzer "FPIA-3000" (manufactured by SYSMEX CORPORATION).

A specific measurement method is as described below.

First, 20 mL of ion-exchanged water from which an impure solid and the like have been removed in advance are charged into a container made of glass. 0.2 mL of a diluted solution prepared by diluting "Contaminon N" (a 10-mass % aqueous solution of a neutral detergent for washing a precision measuring device formed of a nonionic surfactant, an anionic surfactant, and an organic builder and having a pH 7, manufactured by Wako Pure Chemical Industries, Ltd.) with ion-exchanged water by three mass fold is added as a dispersant to the container. Further, 0.02 g of a measurement sample is added to the container, and then the mixture is subjected to dispersion treatment with an ultrasonic dispersing machine for 2 minutes so that a dispersion liquid for measurement may be obtained. At that time, the dispersion liquid is cooled so as to have a temperature of 10° C. or more and 40° C. or less. A desktop ultrasonic cleaning and dispersing machine having an oscillatory frequency of 50 kHz and an electrical output of 150 W (such as a "VS-150" (manufactured by VELVO-CLEAR)) is used as the ultrasonic dispersing machine. A predetermined amount of ion-exchanged water is charged into a water tank, and 2 mL of the Contaminon N are added to the water tank.

The flow-type particle image analyzer mounted with an "UPlanApro" (magnification: 10, numerical aperture: 0.40) as an objective lens is used in the measurement, and a particle sheath "PSE-900A" (manufactured by SYSMEX CORPORATION) is used as a sheath liquid. The dispersion liquid prepared in accordance with the above-mentioned procedure is introduced into the flow-type particle image analyzer, and 3,000 toner particles are subjected to measurement according to the total count mode of an HPF measurement mode. Then, the average circularity of the toner particles is determined with a binarization threshold at the time of particle analysis set to 85% and particle diameters to be analyzed limited to ones each corresponding to a circle-equivalent diameter of 1.985 μm or more and less than 39.69 μm.

On the measurement, automatic focusing is performed with standard latex particles (obtained by diluting, for example, "RESEARCH AND TEST PARTICLES Latex Microsphere Suspensions 5200A" manufactured by Duke Scientific with ion-exchanged water) prior to the initiation of the measurement. After that, focusing is preferably performed every two hours from the initiation of the measurement.

It should be noted that in the present invention, a flow-type particle image analyzer which has been subjected to a calibration operation by SYSMEX CORPORATION and received a calibration certificate issued by SYSMEX CORPORATION is used. The measurement is performed under measurement and analysis conditions identical to those at the time of the reception of the calibration certificate except that particle diameters to be analyzed are limited to ones each corresponding to a circle-equivalent diameter of 1.985 μm or more and less than 39.69 μm.

The measurement principle of the flow-type particle image analyzer "FPIA-3000" (manufactured by SYSMEX CORPORATION) is as follows: a flowing particle is photographed as a static image and the image is analyzed. A sample loaded into a sample chamber is fed into a flat sheath flow cell by a sample suction syringe. The sample fed into the flat sheath flow cell is sandwiched between sheath liquids to form a flat flow. The sample passing the inside of the flat sheath flow cell is irradiated with strobe light at an interval of 1/60 second, and hence the flowing particle can be photographed as the static image. In addition, the particle is photographed in a state of being in focus because the flow is flat. The particle image is taken with a CCD camera, the taken image is subjected to image processing at an image processing resolution of 512×512 pixels (0.37×0.37 μm per pixel), the borders of the respective particle images are sampled, and a projected area S, perimeter L, and the like of each particle image are measured.

Next, a circle-equivalent diameter and a circularity are determined by using the area S and the perimeter L. The circle-equivalent diameter refers to the diameter of a circle having the same area as the projected area of a particle image, and the circularity is defined as a value obtained by dividing the perimeter of a circle determined from the circle-equivalent diameter by the perimeter of a particle projected image and is calculated from the following equation.

$$\text{Circularity}=2\times(\pi\times S)^{1/2}/L$$

When a particle image is circular, its circularity becomes 1.000. As the degree of unevenness of the outer periphery of the particle image enlarges, the value for the circularity reduces. After the circularity of each particle has been calculated, the circularity range of from 0.200 or more to 1.000 or less is divided into 800 sections, the arithmetic average of the resultant circularities is calculated, and the value is defined as an average circularity.

<Method of Measuring Acid Value of Polyester Resin>

The acid value of the polyester resin is measured in conformity with JIS K 1557-1970. A specific measurement method is described below.

2.0 Grams of a pulverized product of the sample are precisely weighed (W (g)). The sample is loaded into a 200-mL Erlenmeyer flask, and 100 mL of a mixed solution containing toluene and ethanol at a ratio of 2:1 are added to dissolve the sample for 5 hours. A phenolphthalein solution is added as an indicator. The solution is titrated with a 0.1 N alcohol solution of KOH and a burette. The amount of the KOH solution at this time is represented by S (mL). A blank test is performed and the amount of the KOH solution at this time is represented by B (mL).

The acid value is calculated from the following equation.

$$\text{Acid value}=[(S-B)\times f\times 5.61]/W$$

(f represents the factor of the KOH solution.)

<Method of Measuring Amount of Component of Silane Compound in Treated Magnetic Material to be Eluted with Styrene>

20 Grams of styrene and 1.0 g of a treated magnetic material are loaded into a vial made of glass having a volume of 50 mL, and the vial made of glass is set in a "KM Shaker" (model: V. SX) manufactured by IWAKI CO., LTD. Its speed is set to 50 and a treatment agent in the treated magnetic material is eluted in styrene by shaking the vial for 1 hour. After that, the treated magnetic material and styrene are separated from each other, and the treated magnetic material is sufficiently dried with a vacuum dryer.

The amount of carbon of each of the treated magnetic material that has been dried and the treated magnetic material before the performance of the elution with styrene per unit weight is measured with a carbon-sulfur analyzer EMIA-320V manufactured by HORIBA, Ltd. The ratio at which the silane compound in the treated magnetic material is eluted in styrene is calculated by using values for the amounts of carbon before and after the elution with styrene. It should be noted that the loading amount of the sample at the time of the measurement with the EMIA-320V is set to 0.20 g, and tungsten and tin are used as combustion improvers.

<Methods of Measuring Dissolution Ratio of Iron Atoms and Amount of Silicon>

In the present invention, the dissolution ratio of the iron atoms of the magnetic material and the content of a metal element except iron with respect the dissolution ratio of the iron atoms can be determined by such methods as described below.

Specifically, 3 liters of deionized water are charged into a 5-liter beaker and are warmed to 50° C. with a water bath. 25 Grams of the magnetic material are added to the beaker and the mixture is stirred. Next, special grade hydrochloric acid is added to provide a 3 mol/L aqueous solution of hydrochloric acid, thereby dissolving the magnetic material. The solution is sampled ten and several times during a time period from the initiation of the dissolution to the time point when the magnetic material is completely dissolved and hence the solution becomes transparent. Each sample is filtered with a membrane filter having an aperture of 0.1 μm and the filtrate is collected. The amounts of the iron atoms and metal element except the iron atoms of the filtrate are determined by inductively coupled plasma emission spectrometry (ICP), and the dissolution ratio of the iron atoms of each sample is determined from the following equation.

Dissolution ratio of iron atoms=(concentration of iron atoms in sample/concentration of iron atoms when magnetic material is completely dissolved)×100

In addition, the content of silicon of each sample is determined, and a relationship between the dissolution ratio of the iron atoms obtained by the measurement and the content of the element detected at that time is used to determine the content of silicon present by the time when the dissolution ratio of the iron atoms becomes 5%.

Hereinafter, the present invention is described more specifically by way of production examples and examples, but the examples by no means limit the present invention. It should be noted that the term "part(s)" in each of all the following formulations means "part(s) by mass".

(Preparation of Substrate 2)

Prepared as the substrate 2 was a product obtained by applying and baking a primer (trade name: DY35-051; manufactured by Dow Corning Toray Co., Ltd.) onto a mandrel made of SUS304 and having a diameter of 6 mm.

(Production of Elastic Roller)

The substrate 2 prepared as described above was placed in a metal mold and an addition-type silicone rubber composition obtained by mixing the following materials was poured into a cavity formed in the metal mold.

- Liquid silicone rubber material (trade name: SE 6724 A/B; manufactured by Dow Corning Toray Co., Ltd.): 100 parts by mass
- Carbon black (trade name: TOKABLACK #4300; manufactured by Tokai Carbon Co., Ltd.): 15 parts by mass
- Silica particles as heat resistance-imparting agent: 0.2 part by mass
- Platinum catalyst: 0.1 part by mass An addition-type silicone rubber composition obtained by mixing materials shown in Table 1 below was poured into the cavity formed in the metal mold. Subsequently, the metal mold was heated to vulcanize and cure the silicone rubber at a temperature of 150° C. for 15 minutes. The substrate having formed on its peripheral surface a cured silicone rubber layer was removed from the metal mold, and then the curing reaction of the silicone rubber layer was completed by further heating the substrate at a temperature of 180° C. for 1 hour. Thus, an elastic roller D-1 in which a silicone rubber elastic layer having a diameter of 12 mm was formed so as to cover the outer peripheral surface of the substrate 2 was produced.

(Preparation of Surface Layer 4)

A synthesis example for obtaining a polyurethane surface layer of the present invention is described below.

(Synthesis of Isocyanate Group-Terminated Prepolymer A-1)

Under a nitrogen atmosphere, 100.0 g of a polypropylene glycol-based polyol (trade name: EXCENOL 4030; manufactured by ASAHI GLASS CO., LTD.) were gradually dropped to 17.7 parts by mass of tolylene diisocyanate (TDI) (trade name: COSMONATE T80; manufactured by Mitsui Chemicals, Inc.) in a reaction vessel while a temperature in the reaction vessel was held at 65° C. After the completion of the dropping, the mixture was subjected to a reaction at a temperature of 65° C. for 2 hours. The resultant reaction mixture was cooled to room temperature to provide an isocyanate group-terminated prepolymer A-1 having an isocyanate group content of 3.8 wt %.

(Synthesis of Isocyanate Group-Terminated Prepolymer A-2)

Under a nitrogen atmosphere, 100.0 g of a butylene adipate-based polyol (trade name: NIPPOLAN 4010; manufactured by Nippon Polyurethane Industry Co., Ltd.) were gradually dropped to 33.8 parts by mass of polymeric MDI (trade name: MILLIONATE MR; manufactured by Nippon Polyurethane Industry Co., Ltd.) in a reaction vessel while a temperature in the reaction vessel was held at 65° C. After the completion of the dropping, the mixture was subjected to a reaction at a temperature of 65° C. for 2 hours. The resultant reaction mixture was cooled to room temperature to provide an isocyanate group-terminated prepolymer A-2 having an isocyanate group content of 4.3 wt %.

(Synthesis of Amino Compound (Compound Represented by Structural Formula (1)))

(Synthesis of Amino Compound B-1)

In a reaction vessel mounted with a stirring apparatus, a temperature gauge, a reflux tube, a dropping apparatus, and a temperature-adjusting apparatus, 100.0 parts by mass (1.67 mol) of ethylenediamine and 100 parts by mass of pure water were warmed to 40° C. while being stirred. Next, 425.3 parts by mass (7.35 mol) of propylene oxide were gradually dropped over 30 minutes while a reaction temperature was held at 40° C. or less. A reaction was performed by further stirring the mixture for 1 hour. Thus, a reaction mixture was obtained. Water was distilled off by heating the resultant reaction mixture under reduced pressure. Thus, 426 g of an amino compound B-1 were obtained.

(Synthesis of Amino Compound B-2)

An amino compound B-2 was obtained in the same manner as in the synthesis example of the amino compound B-1 except that the blending amount of propylene oxide and the reaction time were changed as shown in Table 1 below.

TABLE 1

| | Kind of amino compound serving as raw material | | Added raw material | | |
|---|---|---|---|---|---|
| No. | Compound | Part(s) by mass | Compound | Part(s) by mass | Reaction time |
| B-1 | Ethylenediamine | 100.0 | Propylene | 425.3 | 1 h |
| B-2 | | | oxide | 1276.0 | 2 h |
| B-3 | Diethylenetriamine | | Ethylene oxide | 235.0 | 1 h |
| B-4 | | | 2-Methyl-tetrahydrofuran | 1377.7 | 2 h |
| B-5 | Tetraethylene-pentamine | | 8-Bromo-1-octanol | 851.5 | 1.5 h |
| B-6 | Butylenediamine | | Ethyleneimine | 215.0 | |
| B-7 | | | 8-Bromo-1-aminooctane | 1040.0 | 1 h |

(Synthesis of Amino Compound B-3)

In a reaction vessel mounted with a stirring apparatus, a temperature gauge, a dropping apparatus, and a temperature-adjusting apparatus, 100.0 parts by mass (0.97 mol) of diethylenetriamine and 100 parts by mass of ethanol were warmed to 40° C. while being stirred. Next, 235.0 parts by mass (5.34 mol) of ethylene oxide were gradually dropped over 30 minutes while a reaction temperature was held at 60° C. or less. A reaction was performed by further stirring the mixture for 1 hour. Thus, a reaction mixture was obtained. Ethanol was distilled off by heating the resultant reaction mixture under reduced pressure. Thus, 276 g of an amino compound B-3 were obtained.

(Synthesis of Amino Compound B-4)

An amino compound B-4 was obtained in the same manner as in the synthesis example of the amino compound B-3 except that ethylene oxide was changed to 2-methyl-tetrahydrofuran and its blending amount and the reaction time were changed as shown in Table 1.

(Synthesis of Amino Compound B-5)

In a reaction vessel mounted with a stirring apparatus, a temperature gauge, a reflux tube, a dropping apparatus, and a temperature-adjusting apparatus, 100.0 parts by mass (0.53 mol) of tetraethylenepentamine and 100 parts by mass of ethanol were warmed to 40° C. while being stirred. Next, 851.5 parts by mass (4.08 mol) of 8-bromo-1-octanol were gradually dropped over 30 minutes while a reaction temperature was held at 40° C. or less. A reaction was performed by further stirring the mixture for 1.5 hours. Thus, a reaction mixture was obtained. Ethanol was distilled off by heating the resultant reaction mixture under reduced pressure. Thus, 1,288 g of an amino compound B-5 were obtained.

(Synthesis of Amino Compound B-6)

In a reaction vessel mounted with a stirring apparatus, a temperature gauge, a reflux tube, a dropping apparatus, and a temperature-adjusting apparatus, 100.0 parts by mass (1.14 mol) of butylenediamine and 100 parts by mass of ethanol were warmed to 40° C. while being stirred. Next, 215.0 parts by mass (5.02 mol) of ethyleneimine were gradually dropped over 30 minutes while a reaction temperature was held at 40° C. or less. A reaction was performed by further stirring the mixture for 1 hour. Thus, a reaction mixture was obtained. Ethanol was distilled off by heating the resultant reaction mixture under reduced pressure. Thus, 216 g of an amino compound B-6 were obtained.

(Synthesis of Amino Compound B-7)

An amino compound B-7 was obtained in the same manner as in the synthesis example of the amino compound B-6 except that ethyleneimine was changed to 8-bromo-1-aminooctane and its blending amount was changed as shown in Table 1.

Table 2 shows the structures of the resultant amino compounds. In the table, n represents the number of repetitions of an amino structural unit represented by the structural formula (1) and m represents an ether repetition number in the case where $R^3$ represents the structural formula (2). In addition, the column "number of groups" in the table represents the number of terminal hydroxyl groups or terminal amino groups in one molecule of each amino compound.

TABLE 2

| Amino compound | | | | | | | |
|---|---|---|---|---|---|---|---|
| | | $R^3$ | $R^5$ | | | Terminal functional | Number of |
| No. | n | Structure | Structure | m | $R^4$ | group | groups |
| B-1 | 1 | $—CH_2CH(CH_3)—OH$ | — | — | $—CH_2CH_2—$ | OH | 4 |
| B-2 | | — | $—CH_2CH(CH_3)—O—$ | 3 | | | 4 |
| B-3 | 2 | $—CH_2CH_2—OH$ | — | — | | | 5 |
| B-4 | | — | $—CH_2CH_2CH(CH_3)CH_2—O—$ | 3 | | | 5 |
| B-5 | 4 | $—(CH_2)_8—OH$ | — | — | | | 7 |
| B-6 | 1 | $—CH_2CH_2—NH_2$ | — | — | $—(CH_2)_4—$ | $NH_2$ | 4 |
| B-7 | | $—(CH_2)_8—NH_2$ | — | — | | | 4 |

Structural formula (1)

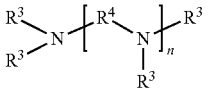

Structural formula (2)

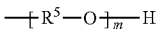

<Production of Toner Carrier 1>

617.9 Parts by mass of the isocyanate group-terminated prepolymer A-1, 34.2 parts by mass of the amino compound B-1, 117.4 parts by mass of carbon black (trade name: MA230; manufactured by Mitsubishi Chemical Corporation), and 130.4 parts by mass of urethane resin fine particles (trade name: ART PEARL C-400; manufactured by Negami Chemical Industrial Co., Ltd.) were stirred and mixed as materials for the surface layer 4.

Next, methyl ethyl ketone (hereinafter sometimes referred to as "MEK") was added to the mixture so that the total solid content ratio became 30 mass %. After that, the contents were mixed with a sand mill. Next, the viscosity of the mixture was further adjusted to from 10 cps or more to 13 cps or less with MEK. Thus, a paint for forming a surface layer was prepared.

A coating film of the paint for forming a surface layer was formed on the surface of the elastic layer of the elastic roller D-1 produced in advance by immersing the elastic roller D-1 in the paint, and was dried. The dried product was further subjected to heat treatment at a temperature of 150° C. for 1 hour to provide a surface layer having a thickness of 15 μm on the outer periphery of the elastic layer. Thus, a toner carrier 1 was produced.

<Production of Toner Carriers 2 to 7>

Paints for forming surface layers were each prepared in the same manner as in the production of the toner carrier 1 except that materials shown in Table 3 below were used as materials for the surface layer 4. Then, toner carriers 2 to 7 were each produced by applying each paint to the elastic roller D-1, and drying and heating the paint in the same manner as in the production of the toner carrier 1.

TABLE 3

| | Isocyanate group-terminated prepolymer | | Compound represented by structural formula (1) | |
|---|---|---|---|---|
| Toner carrier | No. | Part(s) by mass | No. | Part(s) by mass |
| 1 | A-1 | 617.9 | B-1 | 34.2 |
| 2 | | 545.0 | B-2 | 107.2 |
| 3 | | 618.9 | B-3 | 33.2 |
| 4 | A-2 | 527.7 | B-4 | 124.4 |

TABLE 3-continued

| | Isocyanate group-terminated prepolymer | | Compound represented by structural formula (1) | |
|---|---|---|---|---|
| Toner carrier | No. | Part(s) by mass | No. | Part(s) by mass |
| 5 | | 575.6 | B-5 | 76.5 |
| 6 | | 623.7 | B-6 | 28.4 |
| 7 | | 584.0 | B-7 | 68.2 |

<Production of Toner Carrier 8>

632.8 Parts by mass of the isocyanate group-terminated prepolymer A-2, 19.5 parts by mass of pentaerythritol, 117.4 parts by mass of carbon black (trade name: MA230; manufactured by Mitsubishi Chemical Corporation), and 130.5 parts by mass of urethane resin fine particles (trade name: ART PEARL C-400; manufactured by Negami Chemical Industrial Co., Ltd.) were stirred and mixed as materials for the surface layer 4.

A paint for forming a surface layer according to a toner carrier 8 was prepared by performing the subsequent procedure in the same manner as in the method of preparing the paint for forming a surface layer according to the production of the toner carrier 1. The toner carrier 8 was produced by applying the paint for forming a surface layer to the surface of the silicone rubber elastic layer of the elastic roller D-1 and drying the paint to form a surface layer in the same manner as in the production of the toner carrier 1.

<Production of Toner Carrier 9>

351.6 Parts by mass of the isocyanate group-terminated prepolymer A-2, 300.5 parts by mass of a polypropylene glycol-based polyol (trade name: EXCENOL 230; manufactured by ASAHI GLASS CO., LTD.), 117.4 parts by mass of carbon black (trade name: MA230; manufactured by Mitsubishi Chemical Corporation), and 130.5 parts by mass of urethane resin fine particles (trade name: ART PEARL C-400; manufactured by Negami Chemical Industrial Co., Ltd.) were stirred and mixed as materials for the surface layer 4.

A paint for forming a surface layer according to a toner carrier 9 was prepared by performing the subsequent procedure in the same manner as in the method of preparing the paint for forming a surface layer according to the production of the toner carrier 1. The toner carrier 9 was produced by applying the paint for forming a surface layer to the surface of the silicone rubber elastic layer of the elastic roller D-1 and drying the paint to form a surface layer in the same manner as in the production of the toner carrier 1.

<Production of Polyester Resin 1>

The following components were loaded into a reaction vessel provided with a cooling tube, a stirring machine, and a nitrogen-introducing tube, and were subjected to a reaction at 230° C. in a stream of nitrogen for 10 hours while produced water was removed by distillation.

Adduct of bisphenol A with 2 mol of EO: 350 parts
Adduct of bisphenol A with 2 mol of PO: 326 parts
Terephthalic acid: 250 parts
Titanium-containing catalyst: 2 parts Next, the mixture was subjected to a reaction under a reduced pressure of from 5 to 20 mmHg, and the resultant was cooled to 180° C. when its acid value became 0.1 or less. 15 Parts by mass of trimellitic anhydride were added to the resultant, and the mixture was subjected to a reaction under normal pressure in a hermetically sealed state for 2 hours. After that, the resultant was taken out and cooled to room temperature, followed by pulverization. Thus, a polyester resin 1 was obtained. The resultant resin had an acid value of 1.0. Table 4 summarizes the physical properties of the resultant resin.

<Production of Polyester Resin 2>

A polyester resin 2 was obtained in the same manner as in the production of the polyester resin 1 except that trimellitic anhydride was not added in the production of the polyester resin 1. The resultant resin had an acid value of 0.1. Table 4 summarizes the physical properties of the resultant resin.

<Production of Polyester Resins 3 and 4>

Polyester resins 3 and 4 were obtained in the same manner as in the production of the polyester resin 1 except that the amount of trimellitic anhydride added was changed in the production of the polyester resin 1. Table 4 summarizes the physical properties of the resultant resins.

TABLE 4

| Polyester resin | Amount of trimellitic anhydride (part(s) by mass) | Number average molecular weight | Glass transition point (Tg) | Acid value (KOH/mg) |
|---|---|---|---|---|
| Polyester resin 1 | 15 | 3,500 | 79.0 | 1.0 |
| Polyester resin 2 | 0 | 3,510 | 79.5 | 0.1 |
| Polyester resin 3 | 70 | 3,490 | 78.5 | 5.0 |
| Polyester resin 4 | 90 | 3,480 | 78.5 | 7.0 |

<Production of Magnetic Iron Oxide 1>

50 Liters of an aqueous solution of ferrous sulfate containing 2.0 mol/L of $Fe^{2+}$ were mixed with 55 liters of a 4.0 mol/L aqueous solution of sodium hydroxide, and the mixture was stirred to provide an aqueous solution of a ferrous salt containing ferrous hydroxide colloid. The temperature of the aqueous solution was kept at 85° C. and an oxidation reaction was performed while air was blown into the solution at 20 L/min. Thus, a slurry containing a core was obtained.

The resultant slurry was filtered by filter press and washed, and then re-slurrying was performed by dispersing the core in water again. Sodium silicate was added in an amount of 0.20 mass % in terms of silicon per 100 parts of the core to the re-slurried liquid to adjust the pH value of the re-slurried liquid to 6.0, and the mixture was stirred. Thus, magnetic iron oxide particles having silicon-rich surfaces were obtained. The resultant slurry was filtered by filter press and washed, and re-slurrying was performed with ion-exchanged water. 500 Grams (10 mass % with respect to the magnetic iron oxide) of an ion exchange resin SK110 (manufactured by Mitsubishi Chemical Corporation) were loaded into the re-slurried liquid (having a solid content of 50 g/L), and ion exchange was performed by stirring the mixture for 2 hours. After that, the ion exchange resin was removed by filtration with a mesh, and the remainder was filtered by filter press and washed, followed by drying and shredding. Thus, a magnetic iron oxide 1 having a number average particle diameter of 0.23 μm was obtained.

<Production of Magnetic Iron Oxide 2>

A magnetic iron oxide 2 was obtained in the same manner as in the production of the magnetic iron oxide 1 except that sodium silicate was added in an amount of 0.50 mass % in terms of silicon per 100 parts of the core. The magnetic iron oxide 2 thus obtained had a volume average particle diameter of 0.23 μm.

<Production of Magnetic Iron Oxide 3>

A magnetic iron oxide 3 was obtained in the same manner as in the production of the magnetic iron oxide 1 except that sodium silicate was added in an amount of 0.60 mass % in terms of silicon per 100 parts of the core. The magnetic iron oxide 3 thus obtained had a volume average particle diameter of 0.23 μm.

<Production of Magnetic Iron Oxide 4>

A magnetic iron oxide 4 was obtained in the same manner as in the production of the magnetic iron oxide 1 except that sodium silicate was added in an amount of 0.05 mass % in terms of silicon per 100 parts of the core. The magnetic iron oxide 4 thus obtained had a volume average particle diameter of 0.23 μm.

<Production of Magnetic Iron Oxide 5>

A magnetic iron oxide 5 was obtained in the same manner as in the production of the magnetic iron oxide 1 except that sodium silicate was added in an amount of 0.02 mass % in terms of silicon per 100 parts of the core. The magnetic iron oxide 5 thus obtained had a volume average particle diameter of 0.23 μm.

<Production of Silane Compound 1>

30 Parts of iso-butyltrimethoxysilane were dropped to 70 parts of ion-exchanged water while the water was stirred. After that, the pH value and temperature of the aqueous solution were held at 5.5 and 60° C., respectively, and hydrolysis was performed by dispersing the solution with a disper blade at a peripheral speed of 0.46 m/s for 120 minutes. After that, the pH value of the aqueous solution was set to 7.0 and the solution was cooled to 10° C. to terminate the hydrolysis reaction. Thus, an aqueous solution containing a silane compound 1 having a hydrolysis ratio of 99% was obtained. Table 5 summarizes the physical properties of the resultant silane compound.

<Production of Silane Compounds 2 to 4>

With regard to silane compounds 2 to 4, the silane compounds 2 to 4 were each obtained in the same manner as in the production example of the silane compound 1 except that the kind of the silane compound, the pH value, the temperature, and the time were changed as shown in Table 5. Table 5 summarizes the physical properties of the resultant silane compounds.

TABLE 5

| | Kind of silane compound | pH | Temperature (° C.) | Time (min) | Number of carbon atoms | Hydrolysis ratio (%) |
|---|---|---|---|---|---|---|
| Silane compound 1 | Iso-butyltrimethoxy-silane | 5.5 | 55 | 120 | 4 | 99 |

TABLE 5-continued

| | Kind of silane compound | pH | Temperature (° C.) | Time (min) | Number of carbon atoms | Hydrolysis ratio (%) |
|---|---|---|---|---|---|---|
| Silane compound 2 | Iso-butyltrimethoxy-silane | 5.5 | 55 | 30 | 4 | 50 |
| Silane compound 3 | Iso-butyltrimethoxy-silane | 5.5 | 55 | 20 | 4 | 45 |
| Silane compound 4 | n-Hexyltrimethoxy-silane | 5.5 | 60 | 120 | 6 | 99 |

<Production of Magnetic Material 1>

100 Parts of the magnetic iron oxide 1 were loaded into a High-Speed Mixer (Model LFS-2 manufactured by Fukae Powtec Corporation), and 7.0 parts of the aqueous solution containing the silane compound 1 were dropped over 2 minutes while the magnetic iron oxide was stirred at a number of revolutions of 2,000 rpm. After that, the contents were mixed and stirred for 5 minutes. Next, in order for the sticking property of the silane compound to be improved, the moisture content of the mixture was reduced by drying the mixture at 50° C. for 2 hours, and then the condensation reaction of the silane compound was advanced by drying the mixture at 110° C. for 4 hours. After that, the resultant was shredded and passed through a sieve having an aperture of 100 μm to provide a magnetic material 1. Table 6 shows the physical properties of the magnetic material 1.

<Production of Magnetic Materials 2 to 10>

Magnetic materials 2 to 10 were each obtained in the same manner as in the production of the treated magnetic material 1 except that the magnetic iron oxide, and the silane compound and its addition amount were changed as shown in Table 6. Table 6 shows the physical properties of the resultant magnetic materials.

TABLE 6

| | Magnetic iron oxide | Silane compound | Number of parts of added aqueous solution of silane compound (part(s) by mass) | Amount of silicon on surface of magnetic iron oxide | Amount of remaining carbon after washing with styrene (mass %) | Treatment method |
|---|---|---|---|---|---|---|
| Magnetic maternal 1 | Magnetic iron oxide 1 | Silane compound 1 | 7.0 (30% aqueous solution) | 0.20 | 0.50 | Gas phase |
| Magnetic maternal 2 | Magnetic iron oxide 1 | Silane compound 2 | 7.0 (30% aqueous solution) | 0.20 | 0.45 | Gas phase |
| Magnetic maternal 3 | Magnetic iron oxide 1 | Silane compound 3 | 7.5 (30% aqueous solution) | 0.20 | 0.45 | Gas phase |
| Magnetic maternal 4 | Magnetic iron oxide 1 | Silane compound 1 | 5.5 (30% aqueous solution) | 0.20 | 0.40 | Gas phase |
| Magnetic maternal 5 | Magnetic iron oxide 1 | Silane compound 4 | 10.0 (30% aqueous solution) | 0.20 | 1.20 | Gas phase |
| Magnetic maternal 6 | Magnetic iron oxide 1 | Silane compound 1 | 5.0 (30% aqueous solution) | 0.20 | 0.35 | Gas phase |
| Magnetic maternal 7 | Magnetic iron oxide 2 | Silane compound 1 | 7.0 (30% aqueous solution) | 0.50 | 0.50 | Gas phase |
| Magnetic maternal 8 | Magnetic iron oxide 3 | Silane compound 1 | 7.0 (30% aqueous solution) | 0.60 | 0.50 | Gas phase |
| Magnetic maternal 9 | Magnetic iron oxide 4 | Silane compound 1 | 7.0 (30% aqueous solution) | 0.05 | 0.33 | Gas phase |
| Magnetic maternal 10 | Magnetic iron oxide 5 | Silane compound 1 | 7.0 (30% aqueous solution) | 0.02 | 0.30 | Gas phase |

<Production of Toner Particles 1>

450 Parts by mass of a 0.1 M aqueous solution of $Na_3PO_4$ were charged into 720 parts by mass of ion-exchanged water, and the mixture was warmed to 60° C. After that, 67.7 parts by mass of a 1.0 M aqueous solution of $CaCl_2$ were added to the mixture. Thus, an aqueous medium containing a dispersant was obtained.

Styrene: 78.0 parts by mass n-Butyl acrylate: 22.0 parts by mass

Divinylbenzene: 0.48 part by mass

Iron complex of monoazo dyes (T-77 manufactured by Hodogaya Chemical Co., Ltd.): 1.5 parts by mass Magnetic material 1: 70.0 parts by mass Polyester resin 1: 10.0 parts by mass (Saturated polyester resin obtained by a condensation reaction between an ethylene oxide adduct of bisphenol A and terephthalic acid, Mn=5,000, acid value=6 mgKOH/g, Tg=68° C.)

The formulations were uniformly dispersed and mixed with an Attritor (Mitsui Miike Kakoki) to provide a monomer composition. The monomer composition was warmed to 60° C., and 10 parts by mass of a paraffin wax (having a melting point of 72° C.) were added to and mixed in the composition to be dissolved. After that, 4.5 parts by mass of a polymerization initiator 2,2'-azobis(2,4-dimethylvaleronitrile) were dissolved therein.

The monomer composition was loaded into the aqueous medium, and the mixture was stirred and granulated at 60° C. under a $N_2$ atmosphere with a TK-type Homomixer (Tokushu Kika Kogyo Co., Ltd.) at 12,000 rpm for 10 minutes. After that, the resultant was subjected to a reaction at 70° C. for 5 hours while being stirred with a paddle stirring blade. After the completion of the reaction, the suspension was cooled and hydrochloric acid was added to wash the suspension, followed by filtration and drying. Thus, toner particles 1 were obtained. Table 7 shows conditions for the production of the toner particles 1.

<Production of Toner Particles 2 to 27>

Toner particles 2 to 27 were each obtained in the same manner as in the production of the toner particles 1 except that the polyester resin and its addition amount, and the magnetic material and its addition amount were changed as shown in Table 7. Table 7 shows conditions for the production of the toner particles 2 to 27.

TABLE 7

| | Polyester resin | | Magnetic material | |
|---|---|---|---|---|
| Toner particles | Kind | Addition amount (part(s)) | Kind | Addition amount (part(s)) |
| 1 | 1 | 10 | 1 | 70 |
| 2 | 2 | 10 | 1 | 70 |
| 3 | 3 | 10 | 1 | 70 |
| 4 | 4 | 10 | 1 | 70 |
| 5 | 1 | 10 | 2 | 70 |
| 6 | 1 | 10 | 3 | 70 |
| 7 | 1 | 10 | 4 | 70 |
| 8 | 1 | 10 | 5 | 70 |
| 9 | 1 | 10 | 6 | 70 |
| 10 | 1 | 10 | 7 | 70 |
| 11 | 1 | 10 | 8 | 70 |
| 12 | 1 | 10 | 9 | 70 |
| 13 | 1 | 10 | 10 | 70 |
| 14 | 4 | 15 | 10 | 70 |
| 15 | 4 | 20 | 10 | 70 |
| 16 | 1 | 10 | 1 | 55 |
| 17 | 1 | 10 | 1 | 50 |
| 18 | 1 | 10 | 1 | 85 |
| 19 | 1 | 10 | 1 | 90 |
| 20 | 1 | 15 | 1 | 50 |
| 21 | 1 | 5 | 1 | 90 |
| 22 | 1 | 20 | 1 | 50 |
| 23 | 1 | 2 | 1 | 90 |
| 24 | 1 | 25 | 1 | 50 |
| 25 | 1 | 20 | 1 | 40 |
| 26 | 1 | 0.5 | 1 | 90 |
| 27 | 1 | 2 | 1 | 110 |

<Production of Toner 1>

100 Parts of the toner particles 1 and 1.2 parts of hydrophobic silica fine particles obtained by treating silica having a primary particle diameter of 12 nm with hexamethyldisilazane and then treating the resultant with a silicone oil, the fine particles having a BET specific surface area value after the treatments of 120 $m^2/g$, were mixed with a Henschel mixer (Mitsui Miike Kakoki) to prepare a toner 1. Table 8 shows the physical properties of the toner 1.

<Production of Toners 2 to 27>

Toners 2 to 27 were each obtained by changing the toner particles in the production of the toner 1 as shown in Table 8. Table 8 shows the physical properties of the toners 2 to 27.

TABLE 8

| Toner | Toner particles | D4 (μm) | Average circularity | Dielectric constant (ε') | Dielectric loss factor (ε'') | Moisture adsorption amount (30° C./90%) |
|---|---|---|---|---|---|---|
| Toner 1 | Toner particles 1 | 8.0 | 0.976 | 30 | 0.15 | 1.5 |
| Toner 2 | Toner particles 2 | 7.9 | 0.974 | 30 | 0.17 | 1.4 |
| Toner 3 | Toner particles 3 | 8.1 | 0.977 | 29 | 0.17 | 1.6 |
| Toner 4 | Toner particles 4 | 8.1 | 0.971 | 29 | 0.19 | 1.7 |
| Toner 5 | Toner particles 5 | 8.0 | 0.970 | 29 | 0.20 | 1.8 |
| Toner 6 | Toner particles 6 | 7.9 | 0.973 | 29 | 0.21 | 1.9 |
| Toner 7 | Toner particles 7 | 8.0 | 0.972 | 28 | 0.21 | 1.9 |
| Toner 8 | Toner particles 8 | 8.1 | 0.972 | 29 | 0.19 | 1.6 |
| Toner 9 | Toner particles 9 | 8.0 | 0.971 | 28 | 0.21 | 2.0 |
| Toner 10 | Toner particles 10 | 7.9 | 0.970 | 29 | 0.22 | 2.0 |
| Toner 11 | Toner particles 11 | 8.0 | 0.971 | 28 | 0.22 | 2.2 |
| Toner 12 | Toner particles 12 | 7.9 | 0.972 | 27 | 0.22 | 2.3 |
| Toner 13 | Toner particles 13 | 8.0 | 0.970 | 27 | 0.22 | 2.4 |
| Toner 14 | Toner particles 14 | 8.1 | 0.972 | 27 | 0.23 | 2.5 |

TABLE 8-continued

| Toner | Toner particles | D4 (μm) | Average circularity | Dielectric constant (ε') | Dielectric loss factor (ε'') | Moisture adsorption amount (30° C./90%) |
|---|---|---|---|---|---|---|
| Toner 15 | Toner particles 15 | 8.0 | 0.970 | 29 | 0.23 | 2.7 |
| Toner 16 | Toner particles 16 | 8.1 | 0.969 | 25 | 0.10 | 1.5 |
| Toner 17 | Toner particles 17 | 8.1 | 0.976 | 23 | 0.08 | 1.5 |
| Toner 18 | Toner particles 18 | 8.0 | 0.977 | 35 | 0.24 | 1.5 |
| Toner 19 | Toner particles 19 | 7.9 | 0.974 | 37 | 0.24 | 1.5 |
| Toner 20 | Toner particles 20 | 8.1 | 0.973 | 23 | 0.05 | 1.7 |
| Toner 21 | Toner particles 21 | 8.0 | 0.976 | 37 | 0.24 | 1.3 |
| Toner 22 | Toner particles 22 | 7.9 | 0.972 | 23 | 0.03 | 1.8 |
| Toner 23 | Toner particles 23 | 8.1 | 0.975 | 37 | 0.30 | 1.2 |
| Toner 24 | Toner particles 24 | 8.0 | 0.974 | 23 | 0.02 | 1.8 |
| Toner 25 | Toner particles 25 | 8.1 | 0.972 | 21 | 0.02 | 1.8 |
| Toner 26 | Toner particles 26 | 8.0 | 0.971 | 37 | 0.35 | 1.2 |
| Toner 27 | Toner particles 27 | 8.0 | 0.969 | 39 | 0.35 | 1.2 |

Example 1

Image-Forming Apparatus

A printer LBP7700C manufactured by Canon Inc. was reconstructed and used in an image output evaluation. The printer was reconstructed as follows: the toner-supplying member of a developing apparatus was reconstructed so as to rotate in a direction opposite to that of a toner carrier as illustrated in FIG. 2 and the application of a voltage to the toner-supplying member was stopped. It should be noted that an abutting pressure was adjusted so that the width of an abutting portion between the toner carrier and an electrostatic latent image bearing member became 1.1 mm. With such construction, a regulation failure can be strictly evaluated. In addition, the printer was reconstructed as follows: the application of a voltage to its regulating member (blade) was also stopped so that fogging under a high-temperature and high-humidity environment could be strictly evaluated. Further, the printer was reconstructed so that the voltage to be applied to the toner carrier could be set to a product condition and a condition higher than the product condition by 200 V. At the time of an evaluation for the fogging, the evaluation was performed at two levels, i.e., the product condition and the condition higher than the product condition by 200 V (for example, when the voltage to be applied to the toner carrier of the product is −600 V, the condition higher than the product condition by 200 V is −400 V).

100 Grams of the toner 1 were loaded into the developing apparatus reconstructed as described above, and a developing apparatus was produced by using the resultant and the toner carrier 2. The produced developing apparatus was set in a black station, and an image was output on 2,000 sheets of paper under a high-temperature and high-humidity environment (32.5° C./80% RH). It should be noted that a horizontal line having a print percentage of 3% was used as the image, and the image output test was performed while the paper was continuously fed.

As a result, a good image free of fogging under the high-temperature and high-humidity environment was able to be obtained. Table 9 shows the result of the evaluation.

Methods for the respective evaluations performed in Examples, Reference Examples, and Comparative Examples of the present invention, and judgment criteria therefor are described below.

<Image Density>

With regard to an image density, a solid image portion was formed and the density of the solid image was measured with a Macbeth reflection densitometer (manufactured by Gretag-Macbeth).

A: The image density is 1.40 or more.

B: The image density is 1.35 or more and 1.39 or less.

C: The image density is 1.30 or more and 1.34 or less.

D: The image density is 1.29 or less.

<Fogging on Drum>

An evaluation for fogging was performed after the output on the first sheet and after the output on the 2,000-th sheet while the voltage to be applied to the toner carrier was set to the two levels, i.e., the product condition and the condition higher than the product condition by 200 V. The fogging was calculated by: taping the top of a drum before transfer in a solid white image with a Mylar tape; attaching the Mylar tape onto paper; measuring the reflectance of the resultant; and subtracting the reflectance of a Mylar tape portion attached onto unused paper from the foregoing reflectance. The drum refers to an electrostatic latent image bearing member (electrophotographic photosensitive member).

Fogging(reflectance) (%)=reflectance (%) on plain paper−reflectance (%) of non-image portion of sample The fogging was measured with a REFLECTOMETER MODEL TC-6DS manufactured by Tokyo Denshoku CO., LTD. A green filter was used as a filter.

A: 5.0% or more

B: 5.1% or more and 10.0% or less

C: 10.1% or more and 20.0% or less

D: 20.1% or more

Examples 2 to 29

Developing apparatus were each produced with such a combination of a toner and a toner carrier as shown in Table 9, and each developing apparatus was subjected to an image output evaluation in the same manner as in Example 1. As a result, in each of all developing apparatus, good images free of fogging under the high-temperature and high-humidity environment were obtained before and after the endurance test. Table 9 shows the results of the evaluations.

Reference Examples 1 to 4

Developing apparatus were each produced with such a combination of a toner and a toner carrier as shown in Table 9, and each developing apparatus was subjected to an image output evaluation in the same manner as in Example 1. As a result, in each of all developing apparatus, results acceptable for practical use were obtained for both the fogging and the image density under the high-temperature and high-humidity environment before and after the endurance test. Table 9 shows the results of the evaluations.

Comparative Examples 1 and 2

Developing apparatus were each produced with such a combination of a toner and a toner carrier as shown in Table 9, and each developing apparatus was subjected to an image output evaluation in the same manner as in Example 1. As a result, in each of the developing apparatus, the fogging under the high-temperature and high-humidity environment tended to worsen. Table 9 shows the results of the evaluations.

TABLE 9

| | | | Density | | Fogging on drum (voltage to be applied to toner carrier of product) | | Fogging on drum (voltage to be applied to toner carrier of product + 200 V) | |
|---|---|---|---|---|---|---|---|---|
| | Toner | Toner carrier | Initial stage | After output on 2,000-th sheet | Initial stage | After output on 2,000-th sheet | Initial stage | After output on 2,000-th sheet |
| Example 1 | Toner 1 | 2 | A(1.50) | A(1.48) | A(0.2) | A(0.3) | A(0.5) | A(0.8) |
| Example 2 | Toner 1 | 3 | A(1.51) | A(1.49) | A(0.3) | A(0.4) | A(0.5) | A(0.9) |
| Example 3 | Toner 2 | 3 | A(1.47) | A(1.41) | A(0.6) | A(1.3) | A(1.5) | A(1.9) |
| Example 4 | Toner 3 | 3 | A(1.49) | A(1.47) | A(0.9) | A(1.5) | A(1.8) | A(2.1) |
| Example 5 | Toner 4 | 3 | A(1.48) | A(1.46) | A(1.0) | A(1.6) | A(2.0) | A(2.5) |
| Example 6 | Toner 5 | 3 | A(1.46) | A(1.43) | A(1.2) | A(1.8) | A(2.2) | A(2.7) |
| Example 7 | Toner 6 | 3 | A(1.45) | A(1.42) | A(1.4) | A(2.2) | A(2.5) | A(3.0) |
| Example 8 | Toner 7 | 3 | A(1.43) | B(1.39) | A(1.7) | A(2.8) | A(3.2) | A(4.0) |
| Example 9 | Toner 8 | 3 | A(1.43) | A(1.41) | A(1.6) | A(2.5) | A(2.9) | A(3.7) |
| Example 10 | Toner 9 | 3 | A(1.42) | B(1.37) | A(1.9) | A(3.0) | A(3.5) | A(4.3) |
| Example 11 | Toner 10 | 3 | A(1.41) | B(1.36) | A(2.1) | A(3.2) | A(3.8) | A(4.5) |
| Example 12 | Toner 11 | 3 | A(1.42) | B(1.36) | A(2.2) | A(3.3) | A(4.0) | A(4.7) |
| Example 13 | Toner 12 | 3 | A(1.41) | B(1.37) | A(2.2) | A(3.4) | A(4.0) | B(5.2) |
| Example 14 | Toner 13 | 3 | A(1.41) | B(1.35) | A(2.3) | A(3.5) | A(4.2) | B(5.4) |
| Example 15 | Toner 14 | 3 | A(1.40) | B(1.36) | A(2.5) | A(3.7) | B(5.2) | B(6.2) |
| Example 16 | Toner 15 | 3 | B(1.38) | B(1.36) | A(2.8) | A(4.0) | B(6.5) | B(7.1) |
| Example 17 | Toner 16 | 3 | B(1.37) | B(1.35) | A(1.0) | A(1.6) | A(2.0) | A(2.5) |
| Example 18 | Toner 17 | 3 | B(1.36) | B(1.35) | A(1.2) | A(1.8) | A(2.1) | A(2.6) |
| Example 19 | Toner 18 | 3 | A(1.47) | A(1.46) | A(3.0) | A(4.2) | B(6.7) | B(7.5) |
| Example 20 | Toner 19 | 3 | A(1.45) | A(1.44) | A(3.5) | A(4.7) | B(7.5) | B(8.7) |
| Example 21 | Toner 20 | 3 | B(1.36) | B(1.35) | A(1.5) | A(2.2) | A(2.5) | A(3.4) |
| Example 22 | Toner 21 | 3 | A(1.45) | A(1.44) | A(3.9) | B(5.2) | B(7.9) | B(9.2) |
| Example 23 | Toner 22 | 3 | B(1.37) | B(1.35) | A(1.8) | A(2.2) | A(2.8) | A(3.8) |
| Example 24 | Toner 23 | 3 | A(1.42) | B(1.37) | A(4.3) | B(5.8) | B(8.5) | B(9.8) |
| Example 25 | Toner 1 | 1 | A(1.45) | B(1.39) | B(5.2) | B(5.7) | B(7.5) | B(8.5) |
| Example 26 | Toner 1 | 4 | A(1.44) | B(1.37) | B(5.4) | B(6.1) | B(8.1) | B(8.9) |
| Example 27 | Toner 1 | 5 | A(1.43) | B(1.38) | B(6.2) | B(6.8) | B(7.6) | B(8.7) |
| Example 28 | Toner 1 | 6 | A(1.44) | B(1.36) | B(6.5) | B(6.9) | B(8.4) | B(9.5) |
| Example 29 | Toner 1 | 7 | A(1.42) | B(1.35) | B(6.1) | B(7.1) | B(8.6) | B(9.8) |
| Reference Example 1 | Toner 24 | 3 | B(1.35) | C(1.32) | A(2.4) | A(4.2) | A(3.4) | B(5.2) |
| Reference Example 2 | Toner 25 | 3 | C(1.32) | C(1.28) | A(2.8) | B(5.2) | A(4.2) | B(6.5) |
| Reference Example 3 | Toner 26 | 3 | A(1.43) | C(1.34) | B(5.2) | B(7.8) | B(9.8) | C(14.3) |
| Reference Example 4 | Toner 27 | 3 | A(1.49) | A(1.41) | B(7.4) | B(9.2) | C(13.4) | C(17.8) |
| Comparative Example 1 | Toner 1 | 8 | A(1.42) | B(1.37) | C(14.2) | C(15.8) | D(22.3) | D(25.7) |
| Comparative Example 2 | Toner 1 | 9 | B(1.39) | C(1.34) | C(14.3) | C(18.4) | D(25.8) | D(34.3) |

<Production of Toner Carrier 10>

(Preparation of Substrate)

Prepared as the substrate 2 was a product obtained by applying and baking a primer (trade name: DY35-051; manufactured by Dow Corning Toray Co., Ltd.) onto a ground cylindrical tube made of aluminum having an outer diameter of 10 mmϕ (diameter) and an arithmetic average roughness Ra of 0.2 μm.

(Production of Elastic Roller)

The substrate prepared in the foregoing was placed in a metal mold and an addition-type silicone rubber composition obtained by mixing the following materials was poured into a cavity formed in the metal mold.

Liquid silicone rubber material (trade name: SE 6724 A/B; manufactured by Dow Corning Toray Co., Ltd.): 100 parts by mass Carbon black (trade name: TOKABLACK #4300; manufactured by Tokai Carbon Co., Ltd.): 15 parts by mass Silica particles as heat resistance-imparting agent: 0.2 part by mass Platinum catalyst: 0.1 part by mass Subsequently, the metal mold was heated to vulcanize and cure the silicone rubber at a temperature of 150° C. for 15 minutes. The substrate having formed on its peripheral surface a cured silicone rubber layer was removed from the metal mold, and then the curing reaction of the silicone rubber layer was completed by further heating the substrate at a temperature of 180° C. for 1 hour. Thus, an elastic roller D-2 in which a silicone rubber elastic layer having a thickness of 0.5 mm and a diameter of 11 mm was formed on the outer periphery of the substrate 2 was produced.

(Production of Surface Layer)

617.9 Parts by mass of the isocyanate group-terminated prepolymer A-1, 34.2 parts by mass of the amino compound B-1, 117.4 parts by mass of carbon black (trade name: MA230; manufactured by Mitsubishi Chemical Corporation), and 130.4 parts by mass of urethane resin fine particles (trade name: ART PEARL C-400; manufactured by Negami Chemical Industrial Co., Ltd.) were stirred and mixed as materials for the surface layer 4.

Next, MEK was added so that the total solid content ratio became 30 mass %. Thus, a paint for forming a surface layer was prepared.

Next, the rubber-free portion of the elastic roller D-2 produced in advance was masked. The masked roller was vertically raised and rotated at 1,500 rpm, and the paint was applied thereto while a spray gun was lowered at 30 mm/s. Subsequently, the applied layer was cured and dried by being heated in a hot-air drying furnace at a temperature of 180° C. for 20 minutes, whereby a surface layer having a thickness of 8 μm was formed on the outer periphery of the elastic layer. Thus, a toner carrier 10 was produced.

<Production of Toner Carriers 11 to 16>

Paints for forming surface layers were each prepared in the same manner as in the production of the toner carrier 10 except that materials shown in Table 10 below were used as materials for the surface layer 4. Then, toner carriers 11 to 16 were each produced by applying each paint to the elastic roller D-2, and drying and heating the paint in the same manner as in the production of the toner carrier 10.

TABLE 10

| | Isocyanate group-terminated prepolymer | | Compound represented by structural formula (1) | |
|---|---|---|---|---|
| Toner carrier | Kind | Part(s) by mass | Kind | Part(s) by mass |
| 10 | A-1 | 617.9 | B-1 | 34.2 |
| 11 | | 545.0 | B-2 | 107.2 |
| 12 | | 618.9 | B-3 | 33.2 |
| 13 | A-2 | 527.7 | B-4 | 124.4 |
| 14 | | 575.6 | B-5 | 76.5 |
| 15 | | 623.7 | B-6 | 28.4 |
| 16 | | 584.0 | B-7 | 68.2 |

Example 30

A printer LBP3100 manufactured by Canon Inc. was reconstructed and used in an image output evaluation. The printer was reconstructed so that the toner carrier 7 abutted with an electrostatic latent image bearing member as illustrated in FIG. 4. It should be noted that an abutting pressure was adjusted so that the width of an abutting portion between the toner carrier and the electrostatic latent image bearing member became 1.0 mm. Further, the printer was reconstructed so that a voltage to be applied to the toner carrier could be set to a product condition and a condition higher than the product condition by 200 V. At the time of an evaluation for fogging, the evaluation was performed at two levels, i.e., the product condition and the condition higher than the product condition by 200 V (for example, when the voltage to be applied to the toner carrier of the product is −600 V, the condition higher than the product condition by 200 V is −400 V).

The foregoing is such a condition that fogging under a high-temperature and high-humidity environment becomes strict because the charge quantity of a toner reduces owing to the absence of any toner-supplying member.

100 Grams of the toner 1 were loaded into the developing apparatus reconstructed as described above, and a developing apparatus was produced by using the resultant and the toner carrier 2. An image was output on 2,000 sheets of paper by using the produced developing apparatus under a high-temperature and high-humidity environment (32.5° C./80% RH). It should be noted that a horizontal line having a print percentage of 3% was used as the image, and the image output test was performed while the paper was continuously fed.

As a result, a good image free of fogging under the high-temperature and high-humidity environment was able to be obtained. Table 11 shows the result of the evaluation.

Examples 31 to 36

Developing apparatus were each produced with such a combination of a toner and a toner carrier as shown in Table 11, and each developing apparatus was subjected to an image output evaluation in the same manner as in Example 30. As a result, in each of all developing apparatus, good images free of fogging under the high-temperature and high-humidity environment were obtained before and after the endurance test. Table 11 shows the results of the evaluations.

TABLE 11

| | Toner | Toner carrier | Density | | Fogging on drum (voltage to be applied to toner carrier of prouct) | | Fogging on drum (voltage to be applied to toner carrier of product + 200 V) | |
|---|---|---|---|---|---|---|---|---|
| | | | Initial stage | After ouput on 2,000-th sheet | Initial stage | After output on 2,000-th sheet | Initial stage | After output on 2,000-th sheet |
| Example 30 | Toner 1 | 10 | A(1.42) | B(1.37) | A(4.1) | B(6.2) | B(6.8) | B(8.9) |
| Example 31 | Toner 1 | 11 | A(1.51) | A(1.46) | A(1.2) | A(1.7) | A(4.2) | A(4.7) |
| Example 32 | Toner 1 | 12 | A(1.50) | A(1.48) | A(0.8) | A(1.5) | A(3.2) | A(4.2) |
| Example 33 | Toner 1 | 13 | A(1.44) | B(1.36) | A(4.3) | B(5.9) | B(7.4) | B(9.6) |
| Example 34 | Toner 1 | 14 | A(1.43) | B(1.37) | A(4.1) | B(5.8) | B(8.4) | B(9.5) |
| Example 35 | Toner 1 | 15 | A(1.43) | B(1.36) | A(4.5) | B(6.4) | B(8.2) | B(9.5) |
| Example 36 | Toner 1 | 16 | A(1.41) | B(1.35) | B(5.1) | B(6.3) | B(7.6) | B(9.4) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269667, filed Dec. 26, 2013, which is hereby incorporated by reference herein in its entirety.

What is claimed is:

1. A developing apparatus for developing an electrostatic latent image formed on a surface of an electrostatic latent image bearing member to form a toner image on the surface of the electrostatic latent image bearing member, the developing apparatus comprising:

a toner for developing the electrostatic latent image;

a toner carrier for carrying the toner; and a regulating member for regulating a layer thickness of the toner carried by the toner carrier, wherein:

the toner comprises a toner containing toner particles each containing a binder resin and a magnetic material, and inorganic fine particles present on surfaces of the toner particles;

the toner has a dielectric loss factor (∈") at a frequency of 100 kHz and a temperature of 30° C. of 0.03 pF/m or more and 0.30 pF/m or less;

the toner carrier includes a substrate, an elastic layer, and a surface layer containing a urethane resin; and the urethane resin has a partial structure derived from a reaction between a compound represented by the following structural formula (1) and a polyisocyanate:

Structural formula (1)

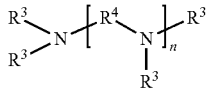

in the structural formula (1):

n represents an integer of 1 or more and 4 or less;

$R^3$'s each independently represent a group selected from the group consisting of the following (a) to (c):

(a) a hydroxyalkyl group having 2 or more and 8 or less carbon atoms, (b) an aminoalkyl group having 2 or more and 8 or less carbon atoms, and (c) a group represented by the following structural formula (2); and $R^4$ represents an alkylene group having 2 or more and 4 or less carbon atoms:

Structural formula (2)

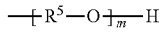

in the structural formula (2):

m in 2 or 3; and $R^5$ represents an alkylene group having 2 or more and 5 or less carbon atoms.

2. A developing apparatus according to claim 1, wherein the dielectric loss factor (∈") of the toner at a frequency of 100 kHz and a temperature of 30° C. is 0.05 pF/m or more and 0.25 pF/m or less.

3. A developing apparatus according to claim 1, wherein the toner has a dielectric constant (∈') of 25 or more and 35 or less.

4. A developing apparatus according to claim 1, wherein the toner has a moisture adsorption amount at a temperature of 30° C. and a humidity of 90% of 2.5 mg/g or less.

5. A developing apparatus according to claim 1, wherein the magnetic material comprises a treated magnetic material obtained by treating a surface of magnetic iron oxide with a silane compound.

6. A developing apparatus according to claim 5, wherein:
the magnetic iron oxide has a silicon atom on the surface; and
an amount of silicon to be eluted when the magnetic iron oxide is dissolved until a dissolution ratio of an iron atom becomes 5 mass % is 0.05 mass % or more and 0.50 mass % or less with reference to the magnetic iron oxide.

7. A developing apparatus according to claim 5, wherein an amount of remaining carbon derived from the silane compound after washing of the treated magnetic material with styrene is 0.40 mass % or more and 1.20 mass % or less with reference to the magnetic iron oxide.

8. A developing apparatus according to claim 5, wherein:
the silane compound comprises a compound obtained by subjecting an alkoxysilane to hydrolysis treatment; and
the alkoxysilane has a hydrolysis ratio of 50% or more.

9. A developing apparatus according to claim 1, wherein:
the toner particles each have a core-shell structure having a core and a shell; and
a resin for forming the shell comprises a polyester-based resin having an acid value of 0.1 mgKOH/g or more and 5.0 mgKOH/g or less.

10. A developing method, comprising developing an electrostatic latent image formed on a surface of an electrostatic latent image bearing member with a developing apparatus to form a toner image on the surface of the electrostatic latent image bearing member,
wherein:
the developing apparatus includes
a toner for developing the electrostatic latent image,
a toner carrier for carrying the toner, and
a regulating member for regulating a layer thickness of the toner carried by the toner carrier;
the toner comprises a toner containing
toner particles each containing a binder resin and a magnetic material, and
inorganic fine particles present on surfaces of the toner particles;
the toner has a dielectric loss factor (∈") at a frequency of 100 kHz and a temperature of 30° C. of 0.03 pF/m or more and 0.30 pF/m or less;
the toner carrier includes
a substrate,
an elastic layer, and
a surface layer containing a urethane resin; and
the urethane resin has a partial structure derived from a reaction between
a compound represented by the following structural formula (1) and
a polyisocyanate:

Structural formula (1)

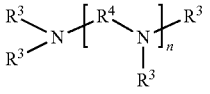

in the structural formula (1):
n represents an integer of 1 or more and 4 or less;
$R^3$'s each independently represent a group selected from the group consisting of the following (a) to (c):
(a) a hydroxyalkyl group having 2 or more and 8 or less carbon atoms,
(b) an aminoalkyl group having 2 or more and 8 or less carbon atoms, and
(c) a group represented by the following structural formula (2); and
$R^4$ represents an alkylene group having 2 or more and 4 or less carbon atoms:

Structural formula (2)

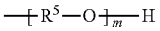

in the structural formula (2):
m is 2 or 3; and
$R^5$ represents an alkylene group having 2 or more and 5 or less carbon atoms.

11. A developing method according to claim 10, wherein the dielectric loss factor (∈") of the toner at a frequency of 100 kHz and a temperature of 30° C. is 0.05 pF/m or more and 0.25 pF/m or less.

12. A developing method according to claim 10, wherein the toner has a dielectric constant (∈') of 25 or more and 35 or less.

13. A developing method according to claim 10, wherein the toner has a moisture adsorption amount at a temperature of 30° C. and a humidity of 90% of 2.5 mg/g or less.

14. A developing method according to claim 10, wherein the magnetic material comprises a treated magnetic material obtained by treating a surface of magnetic iron oxide with a silane compound.

15. A developing method according to claim 14, wherein:
the magnetic iron oxide has a silicon atom on the surface; and
an amount of silicon to be eluted when the magnetic iron oxide is dissolved until a dissolution ratio of an iron atom becomes 5 mass % is 0.05 mass % or more and 0.50 mass % or less with reference to the magnetic iron oxide.

16. A developing method according to claim 14, wherein an amount of remaining carbon derived from the silane compound after washing of the treated magnetic material with styrene is 0.40 mass % or more and 1.20 mass % or less with reference to the magnetic iron oxide.

17. A developing method according to claim 14, wherein:
the silane compound comprises a compound obtained by subjecting an alkoxysilane to hydrolysis treatment; and
the alkoxysilane has a hydrolysis ratio of 50% or more.

18. A developing method according to claim 10, wherein:
the toner particles each have a core-shell structure having a core and a shell; and
a resin for forming the shell comprises a polyester-based resin having an acid value of 0.1 mgKOH/g or more and 5.0 mgKOH/g or less.

19. An image-forming apparatus, comprising:
an electrostatic latent image bearing member;
a charging unit for charging a surface of the electrostatic latent image bearing member;
an image exposure unit for irradiating the charged surface of the electrostatic latent image bearing member with image exposure light to form an electrostatic latent image on the surface of the electrostatic latent image bearing member;
a developing apparatus for developing the electrostatic latent image formed on the surface of the electrostatic latent image bearing member to form a toner image on the surface of the electrostatic latent image bearing member;

a transferring unit for transferring the toner image formed on the surface of the electrostatic latent image bearing member onto a transfer material through or without through an intermediate transfer member; and a fixing unit for fixing the toner image transferred onto the transfer material onto the transfer material, wherein the developing apparatus comprises the developing apparatus according to claim 1.

20. An image-forming method, comprising:

a charging step of charging a surface of an electrostatic latent image bearing member;

an image exposure step of irradiating the charged surface of the electrostatic latent image bearing member with image exposure light to form an electrostatic latent image on the surface of the electrostatic latent image bearing member;

a developing step of developing the electrostatic latent image formed on the surface of the electrostatic latent image bearing member to form a toner image on the surface of the electrostatic latent image bearing member;

a transferring step of transferring the toner image formed on the surface of the electrostatic latent image bearing member onto a transfer material through or without through an intermediate transfer member; and a fixing step of fixing the toner image transferred onto the transfer material onto the transfer material, wherein the developing step comprises a step to be performed by the developing method according to claim 10.

* * * * *